US007390120B2

(12) United States Patent
Midas et al.

(10) Patent No.: US 7,390,120 B2
(45) Date of Patent: Jun. 24, 2008

(54) METHOD OF CLAMPING A CONTAINER IN A PAINT MIXER

(75) Inventors: Thomas J. Midas, Oak Park Heights, MN (US); Aaron Curtis, Eagan, MN (US); Brent Thomas Harrold, Burnsville, MN (US)

(73) Assignee: Red Devil Equipment Company, Plymouth, MN (US)

( * ) Notice: Subject to any disclaimer, the term of this patent is extended or adjusted under 35 U.S.C. 154(b) by 0 days.

(21) Appl. No.: 11/856,463

(22) Filed: Sep. 17, 2007

(65) Prior Publication Data

US 2008/0008027 A1 Jan. 10, 2008

Related U.S. Application Data

(62) Division of application No. 10/880,236, filed on Jun. 29, 2004, now Pat. No. 7,284,901.

(51) Int. Cl.
*B01F 11/00* (2006.01)

(52) U.S. Cl. ..... 366/209

(58) Field of Classification Search ..... 366/110–112, 366/114, 208–219, 605; 70/190–191, 207, 70/209–211, 224, DIG. 9; 74/411.5; 251/107–109, 251/90, 230, 114, 116
See application file for complete search history.

(56) References Cited

U.S. PATENT DOCUMENTS 878,042 A * 2/1908 Chesterman ..... 70/230
1,200,797 A * 10/1916 Barbe ..... 411/328
1,366,114 A * 1/1921 Boggs ..... 70/180
1,406,315 A * 2/1922 Whittaker ..... 411/294
1,437,871 A * 12/1922 Szymanski et al. ..... 411/328
1,454,712 A * 5/1923 Ellis ..... 411/315
1,463,622 A * 7/1923 Lummer ..... 411/326
1,486,741 A * 3/1924 Groves ..... 411/328
1,504,189 A * 8/1924 Rees ..... 411/328
1,739,410 A * 12/1929 Murphy ..... 411/328
1,986,204 A * 1/1935 Johnson ..... 134/150

(Continued)

FOREIGN PATENT DOCUMENTS

DE 31 11 437 A 1 10/1982

(Continued)

OTHER PUBLICATIONS

Red Devil Inc., Super High Sped Paint Mixer Mods 5500—E3.A3, 13 & 03 Operating Instructions, 1983 (10 pgs).

(Continued)

*Primary Examiner*—Charles E Cooley
(74) *Attorney, Agent, or Firm*—Faegre & Benson LLP

(57) ABSTRACT

A gyroscopic paint mixer having a ratcheting lead screw paint container clamp and lock with a pawl releasably engaging an axial relief in the lead screw. A clamping frame is driven by a shaft maintained in concentricity with a stationary ring gear by an antifriction bearing mounted between the shaft and ring gear. A support plate has a peripheral lip forming a first recess sized to position either a generally square paint container or a generally D-shaped paint container. The support plate has a second recess to position a cylindrical paint container concentric to a spin axis.

5 Claims, 30 Drawing Sheets

U.S. PATENT DOCUMENTS

| | | | | | |
|---|---|---|---|---|---|
| 2,077,953 | A | * | 4/1937 | Pesce | 411/328 |
| 2,372,889 | A | * | 4/1945 | Duggan | 411/328 |
| 3,633,719 | A | * | 1/1972 | Lynch | 193/10 |
| 3,729,201 | A | * | 4/1973 | Dollenmayer | 360/86 |
| 3,743,300 | A | * | 7/1973 | Johnson et al. | 360/82 |
| 3,953,891 | A | * | 4/1976 | Wilmoth | 360/254 |
| 3,993,180 | A | * | 11/1976 | Locke | 400/157 |
| 4,356,996 | A | * | 11/1982 | Linder et al. | 251/82 |
| 4,415,270 | A | * | 11/1983 | Heinis et al. | 366/216 |
| 4,445,782 | A | * | 5/1984 | Sparrow, Jr. | 366/217 |
| 4,582,307 | A | * | 4/1986 | Wang | 269/182 |
| 4,789,245 | A | * | 12/1988 | Morbeck | 366/217 |
| 4,823,633 | A | * | 4/1989 | Pike | 74/411.5 |
| 5,066,136 | A | * | 11/1991 | Johnson | 366/209 |
| 5,157,983 | A | * | 10/1992 | Sankovic | 74/411.5 |
| 5,197,802 | A | * | 3/1993 | Miller et al. | 366/217 |
| 5,261,744 | A | * | 11/1993 | Brunn | 366/217 |
| 5,383,163 | A | * | 1/1995 | Brunn | 366/217 |
| 5,547,278 | A | * | 8/1996 | Xie | 366/203 |
| 5,711,601 | A | * | 1/1998 | Thomas et al. | 366/209 |
| 5,788,371 | A | * | 8/1998 | Neri et al. | 366/217 |
| 5,897,204 | A | * | 4/1999 | Dittmer et al. | 366/209 |
| 7,052,334 | B1 | * | 5/2006 | Cabay et al. | 439/803 |
| 7,059,763 | B2 | * | 6/2006 | Sordelli et al. | 366/217 |
| 7,165,879 | B2 | * | 1/2007 | Midas et al. | 366/209 |
| 7,284,901 | B2 | * | 10/2007 | Midas et al. | 366/217 |
| 7,311,437 | B2 | * | 12/2007 | Midas et al. | 366/217 |
| 2004/0134297 | A1 | * | 7/2004 | West et al. | 74/425 |
| 2005/0213426 | A1 | * | 9/2005 | Midas et al. | 366/209 |
| 2005/0286341 | A1 | * | 12/2005 | Midas et al. | 366/217 |
| 2007/0081416 | A1 | * | 4/2007 | Midas et al. | 366/209 |
| 2007/0081417 | A1 | * | 4/2007 | Midas et al. | 366/209 |
| 2007/0081418 | A1 | * | 4/2007 | Midas et al. | 366/209 |
| 2008/0008027 | A1 | * | 1/2008 | Midas et al. | 366/209 |

FOREIGN PATENT DOCUMENTS

DE 3111431 A1 * 10/1982

OTHER PUBLICATIONS

Red Devil Inc., super High Sped Paint Mixer Models 5500—C2 Operating Instruction—Parts List, 1982 (9 pgs).

Index Corporation, Gryoflex Mixer for Standard and Non-Standard 1 Gallon Cans, Website (1 pg), date unknown.

H.E.R.O. Industries, Model S2800 High Speed Gyroscopic Paint Mixer User and Maintenance Guide (7 pgs), date unknown.

International Preliminary Report on Patentability and Written Opinion of International Application No. PCT/US2005/022941, filed Jun. 27, 2005, both mailed Jan. 18, 2007.

* cited by examiner

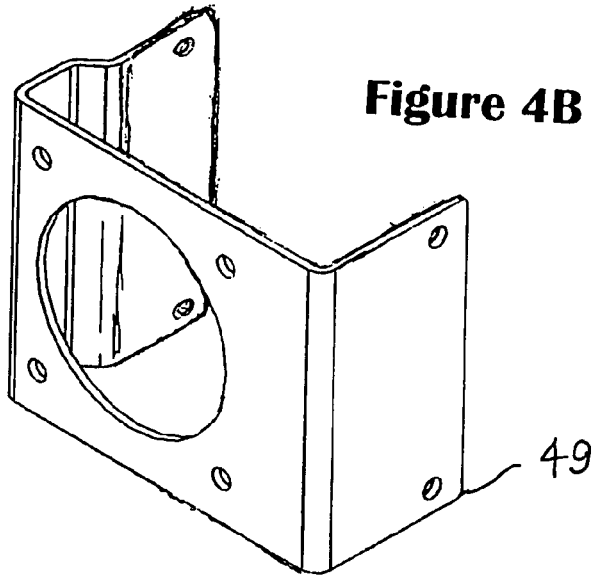
Figure 4B
Figure 4D
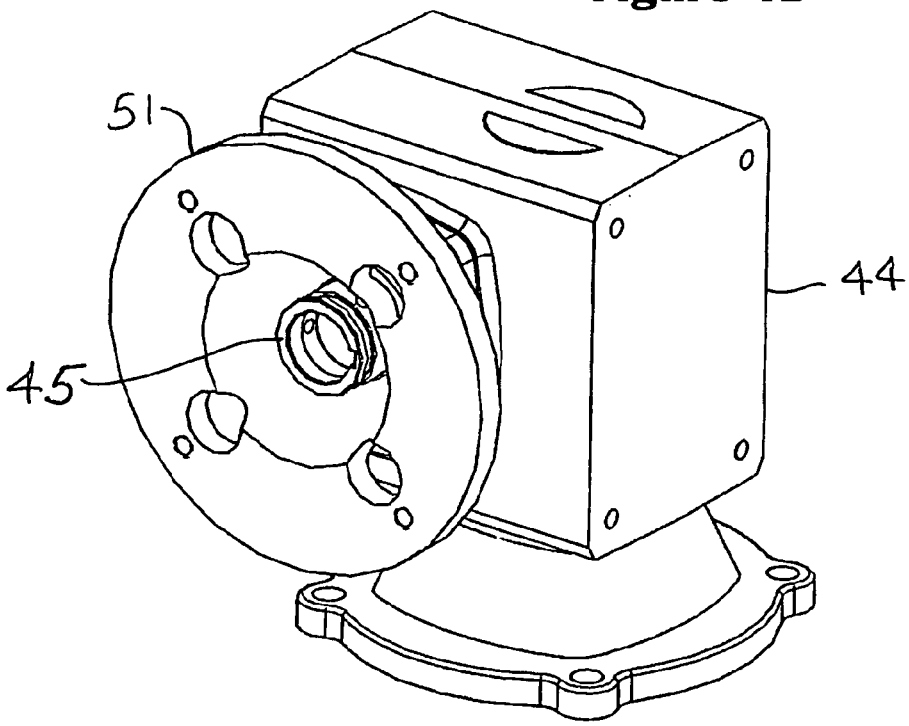

METHOD OF CLAMPING A CONTAINER IN A PAINT MIXER

CROSS-REFERENCE TO RELATED APPLICATION

This application is a division of application Ser. No. 10/880,236 filed Jun. 29, 2004, now U.S. Pat. No. 7,284,901 B2, the entire contents of which are hereby incorporated by reference.

FIELD OF THE INVENTION

This invention is in the field of paint mixing machines, particularly gyroscopic and platform or orbital mixers.

BACKGROUND OF THE INVENTION

In the past, paint mixers of the gyroscopic and platform types used various clamping mechanisms to secure the paint container in the mixer. Such mechanisms typically required an operator to advance or retract a clamping pad or plate with respect to one end of the paint container or containers held for mixing. Furthermore, to retain the paint container securely, the clamp mechanism requires a lock to prevent unintentional release or slippage of such clamping mechanisms. Such clamping and locking mechanisms often were constructed of a number of parts needing alignment for proper operation, due in part to the separation of functions between the clamping parts and the locking parts, which nevertheless were required to work together. The relatively large number of parts on occasion caused relatively high friction in the mechanism, making it difficult for the operator to use the clamp and lock. Furthermore, the large number of parts added to the cost of manufacture and service.

SUMMARY OF THE INVENTION

The present invention, in one aspect, is directed to a simple and efficient combined clamp and lock mechanism in which certain parts are used simultaneously to both clamp and lock and are useful in gyroscopic and platform or orbital mixers. In this aspect, an apparatus and method are provided in which a lead screw with a helical thread has at least one axial relief is received in a collar secured to a clamping frame of the paint mixer and having a mating thread, and a pawl engages the axial relief of the lead screw permitting rotation of the lead screw in a first direction advancing into the collar and selectively preventing rotation of the lead screw in a second direction opposite to the first direction.

In another aspect, some prior art gyroscopic mixers had a rotating shaft projecting through a stationary gear, but did not have positive alignment between the center of the shaft and the center of the gear. The present invention overcomes this eccentricity of the prior art by providing a centering structure supporting the shaft which preferably is an antifriction bearing centered in the stationary gear and supporting the rotating shaft in concentric alignment with the gear such that a planetating gear orbit is concentric to a pitch circle of the ring gear.

In another aspect directed to a gyroscopic mixer of the type having a clamping frame including a pressure plate and a support plate in opposed relationship to clamp a paint container, the present invention includes first and second recesses on the support plate, with a raised edge on the support plate forming the first recess sized to closely interfit with a generally square paint container, with an inside diameter of the first recess being substantially equal to an external diagonal dimension of the square paint container. The second recess on the support plate is preferably concentric to the first recess and has an inside diameter substantially equal to an outside diameter of a generally cylindrical paint container. As a result, the clamping frame of the paint mixer will substantially geometrically center either of the square or cylindrical paint containers when received on the support plate.

BRIEF DESCRIPTION OF THE DRAWINGS

FIG. 4B is a perspective view of the mounting bracket of FIG. 4A.

FIG. 4D is a perspective view showing the mounting flange of FIG. 4C.

DETAILED DESCRIPTION

Figure 4:
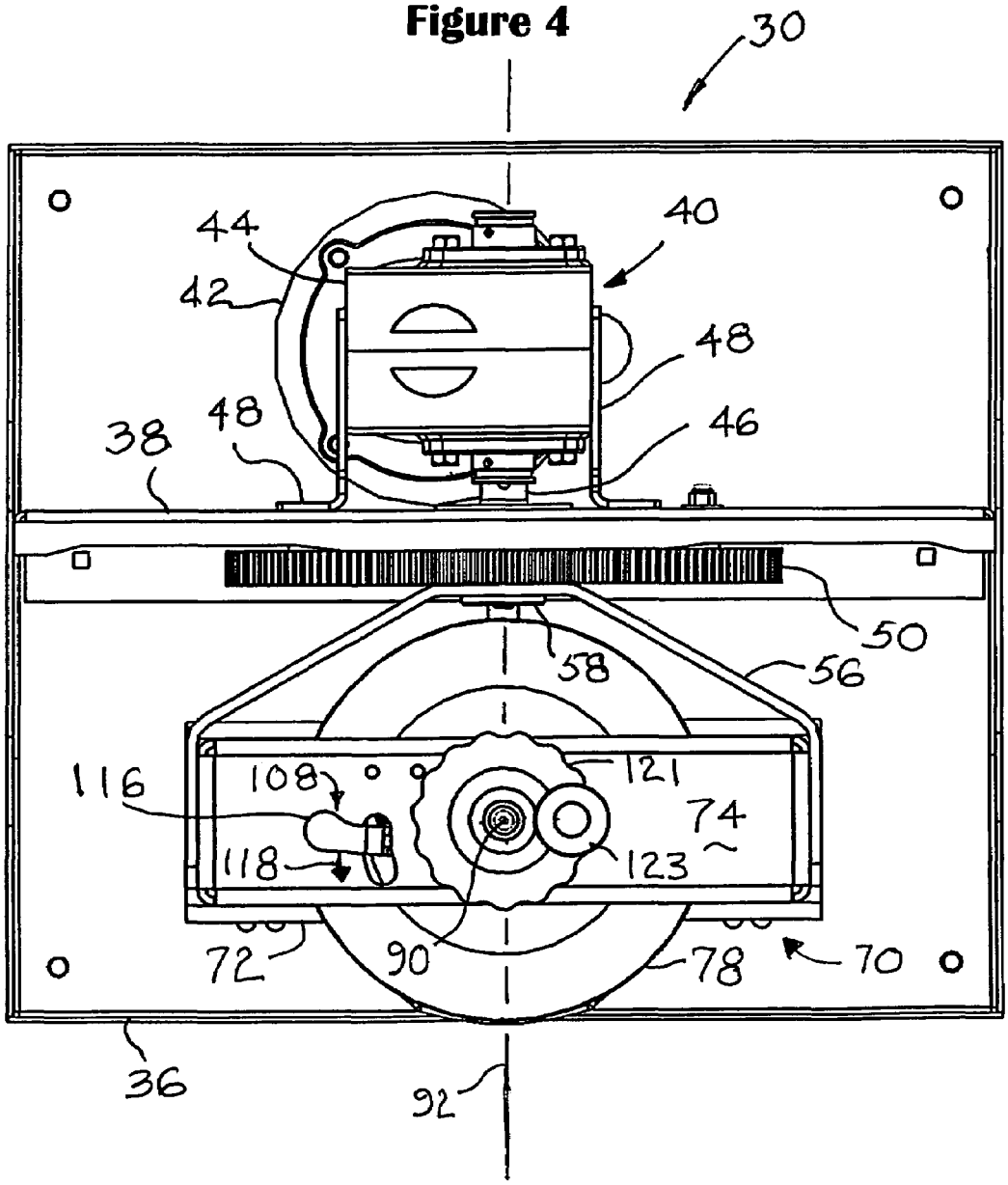
FIG. 4 is a top plan view of the mixer of FIG. 1.
Figure 4C:
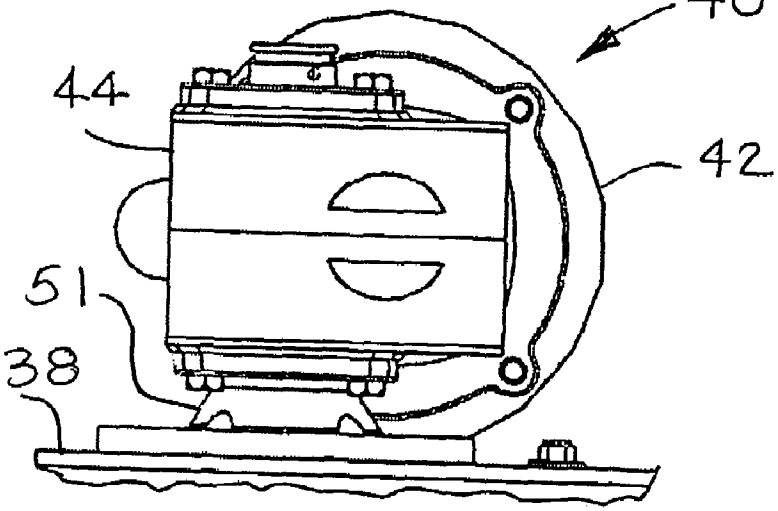
FIG. 4C is a fragmentary view of a portion of FIG. 4, showing an alternative embodiment for a mounting flange for the right angle gearbox useful in the practice of the present invention.
Figure 4A:
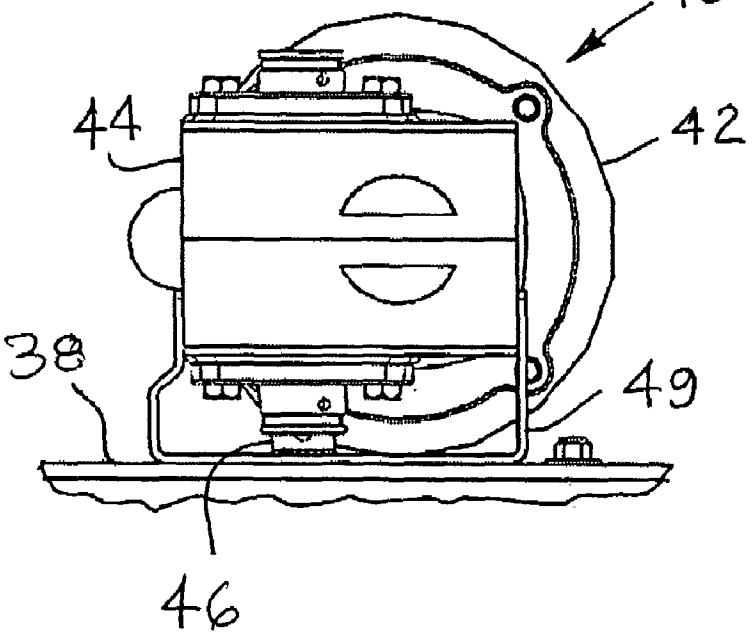
FIG. 4A is a fragmentary view of a portion of FIG. 4, showing an alternative embodiment for a mounting bracket for a right angle gearbox useful in the practice of the present invention.

Referring to the Figures, and most particularly to FIGS. 1-4D, a paint mixer 30 useful in the practice of the present invention may be seen. As shown, mixer 30 is a gyroscopic type mixer that has a one gallon paint container capacity. However, it is to be understood that the present invention is also applicable to other sizes of gyro mixers (e.g., 5 gallon) and, in certain aspects, to platform mixers of various capacities. Mixer 30 is shown without an enclosure, however chain line 32 is used to indicate that preferably an enclosure is used to surround the mixer 30, but forms no part of the present invention. Mixer 30 is supported by a base 34 having a horizontal member 36 and a vertical member 38, each preferably formed of relatively rigid material, such as heavy gauge sheet metal. Members 36 and 38 may be secured together, for example, at locations 39 by conventional fastenings, such as machine screws or welding. A drive mechanism 40 is mounted to member 38 and includes an electric motor 42 and a right angle gear box 44 having an output shaft 46. Motor 42 is preferably mounted to gear box 44 which may be mounted to member 38 by a pair of brackets 48. Referring to FIGS. 4A and 4B, the pair of brackets 48 may be replaced by a single bracket 49. Referring now to FIGS. 4C and 4D, in an alternative embodiment, the gear box 44 may be mounted to member 38 by a flange 51 surrounding an output shaft coupling 45.

A stationary ring gear 50 is mounted to upright or vertical member 38 by a plurality of standoffs or spacers 52. It is to be understood that the spacers 52 may, in the alternative, be incorporated integrally into the gear 50. Shaft 46 projects through a machined bore 54 in ring gear 50 and is attached to a yoke arm 56 through a hub 58. In one aspect of the present invention, a bearing 60 which may be a sleeve bearing or an antifriction type bearing, i.e., one having rolling elements such as balls 62 between an outer race 64 and an inner race 66 is received in machined bore 54 and supports shaft 46, with the outer race received in bore 54 which is machined to be concentric to a pitch circle of the ring gear 50, such that the shaft 46 is held concentric to the pitch circle of the gear 50 by bearing 60 located in bore 54. Alternatively, a bore may be machined in gear 50 to directly support or "journal" shaft 46 in ring gear 50 concentric to the pitch circle of gear 50, if desired.

Figure 1:
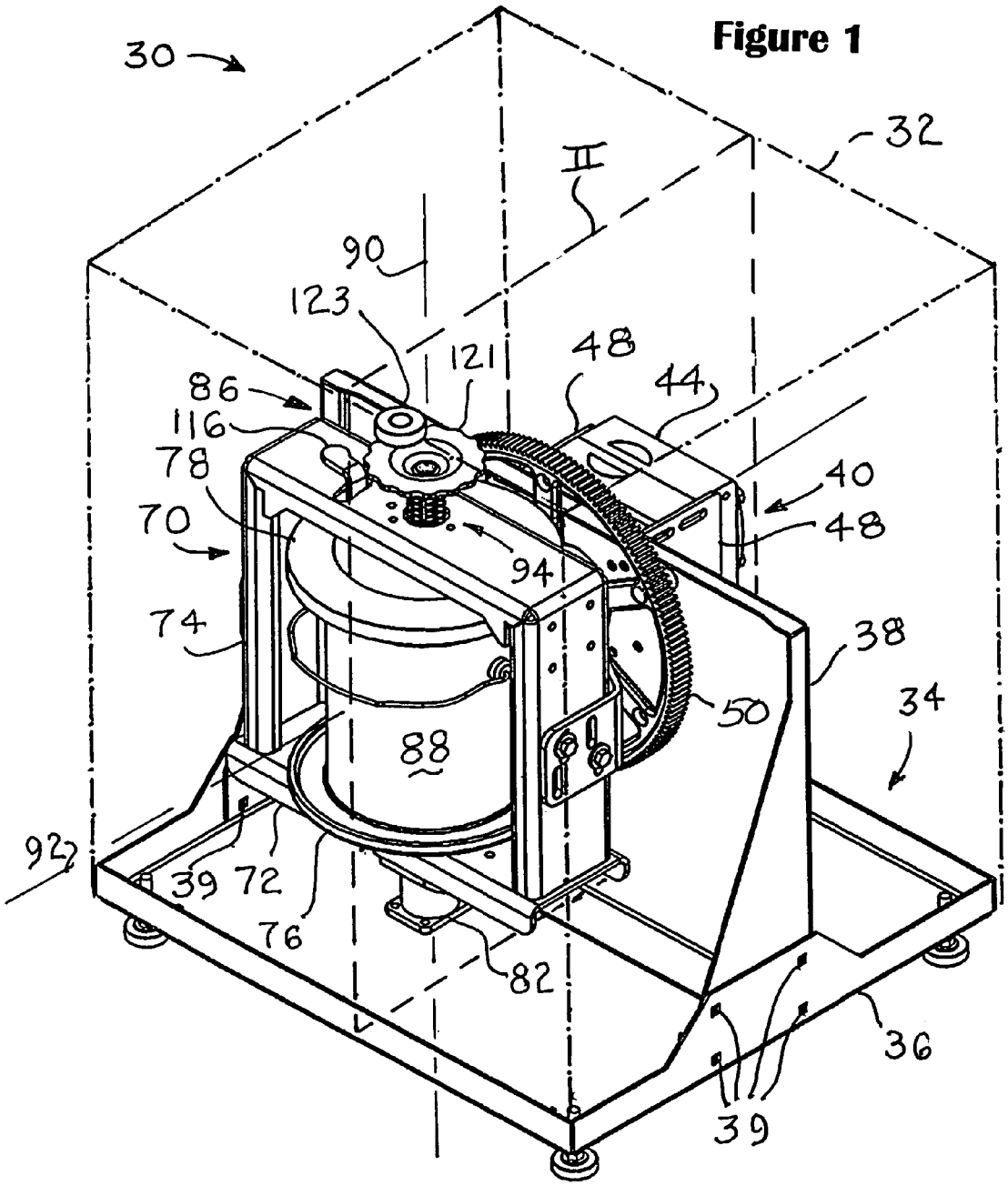
FIG. 1 is a perspective view of a gyroscopic paint mixer useful in the practice of the present invention, with an enclosure shown in phantom.
Figure 2:
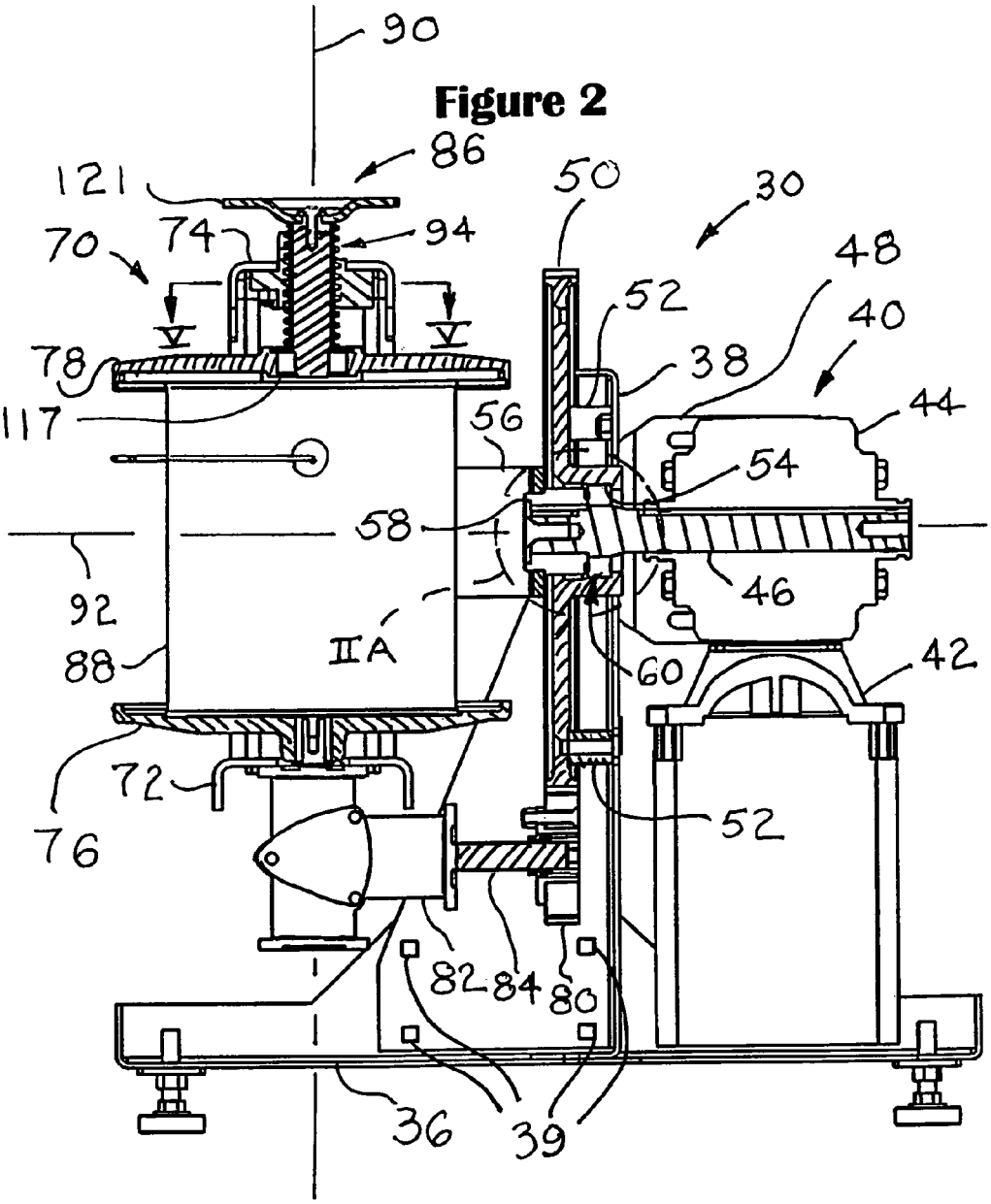
FIG. 2 is a side view, partly in section through a central plane II in FIG. 1, of the mixer of FIG. 1.
Figure 2A:
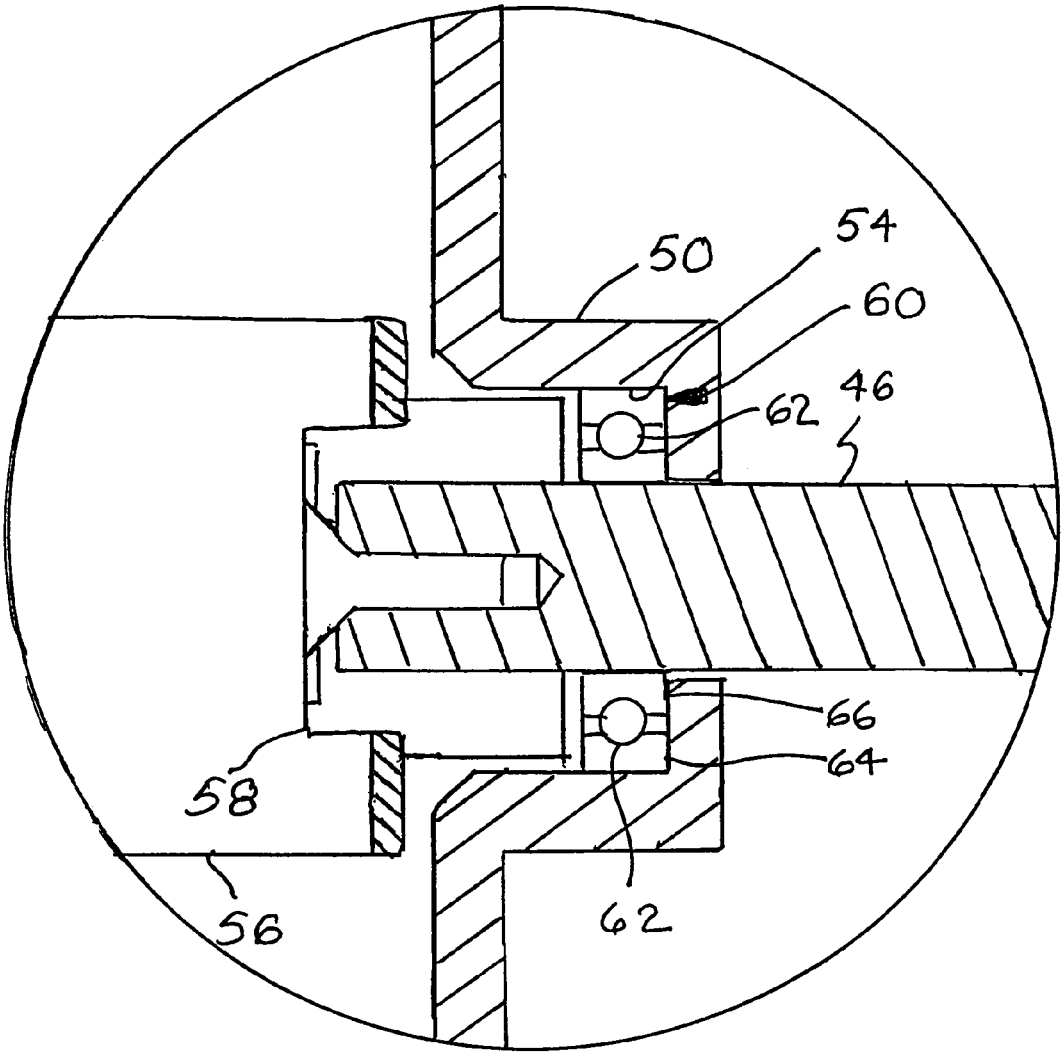
FIG. 2A is an enlarged fragmentary view of a portion IIA of FIG. 2, showing certain details thereof.
Figure 3:
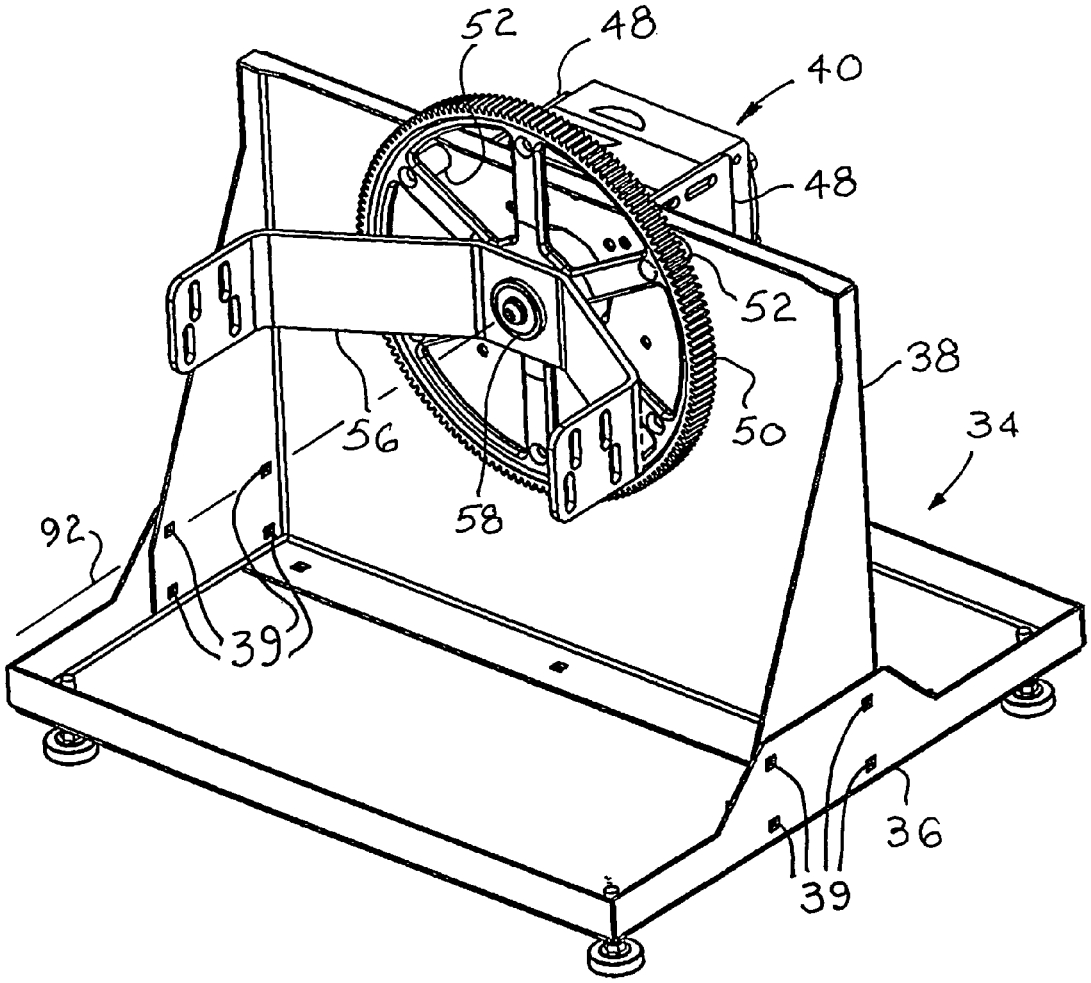
FIG. 3 is a perspective view of the mixer of FIG. 1, with a clamping frame removed to show details of a stationary ring gear.

Referring now also to FIG. 2A, the present invention includes an improvement to a gyroscopic paint mixer of the type having a non-rotating ring gear about which a planetating gear rotates to provide a spin motion to a paint container in a clamping frame driven by a shaft projecting through the ring gear. The improvement in combination with the mixer includes structure supporting the shaft projecting through the ring gear such that the planetating gear orbit is concentric to a pitch circle of the ring gear. The structure supporting the shaft includes a bore in the ring gear machined to be concentric to the pitch circle of the ring gear. Preferably, the structure supporting the shaft includes a bearing supporting the shaft projecting through the ring gear such that the planetating gear orbit is concentric to the pitch circle of the ring gear.

More particularly, the structure supporting the shaft may include an antifriction bearing having an outer race located concentric to a pitch circle of the ring gear and an inner race supporting the shaft projecting through the ring gear such that the planetating gear orbit is concentric to the pitch circle of the ring gear.

Referring now again to FIGS. 1, 2 and 4, in one aspect, the present invention is directed to a clamp and lock assembly and method. A clamping frame 70 is supported by yoke arm 56. Clamping frame 70 may include a lower cross member 72 and an inverted U shaped member 74 attached thereto. Alternatively, clamping frame may include an upper cross member (not shown) similar to the lower cross member 72, along with a pair of upright members (not shown) corresponding to the side legs of the inverted U shaped member 74. Frame 70 may carry a support plate 76 and a pressure plate 78. As will be described in more detail infra, support plate is rotated by a planet gear 80 driving a planet gear box 82 through a shaft 84. Pressure plate 78 is able to be moved towards and away from support plate 76 by a clamp and lock apparatus 86. Plates 76 and 78 clamp a paint container, such as a cylindrical paint container 88 while the mixer 30 rotates the paint container about a spin axis 90 and a tumble axis 92.

Referring now also to FIGS. 4-7, various details of the clamp and lock apparatus 86 may be seen. The apparatus 86 includes a lead screw 94 having a male helical thread 96 and at least one axial relief 98, and preferably a plurality of axial reliefs 98, 100, 102. The axial reliefs interrupt the helical thread 96 (which preferably is an ACME type thread). As used herein, "axial relief" means sufficient removal of material from the lead screw to provide a recess for receipt of a tooth (or which creates a wall surface for contact by a tooth) of a pawl to lock the lead screw against unintended rotation. The clamp and lock apparatus 86 may also include a collar 104 secured to the upper member 74 of the clamping frame 70.

Figure 7:
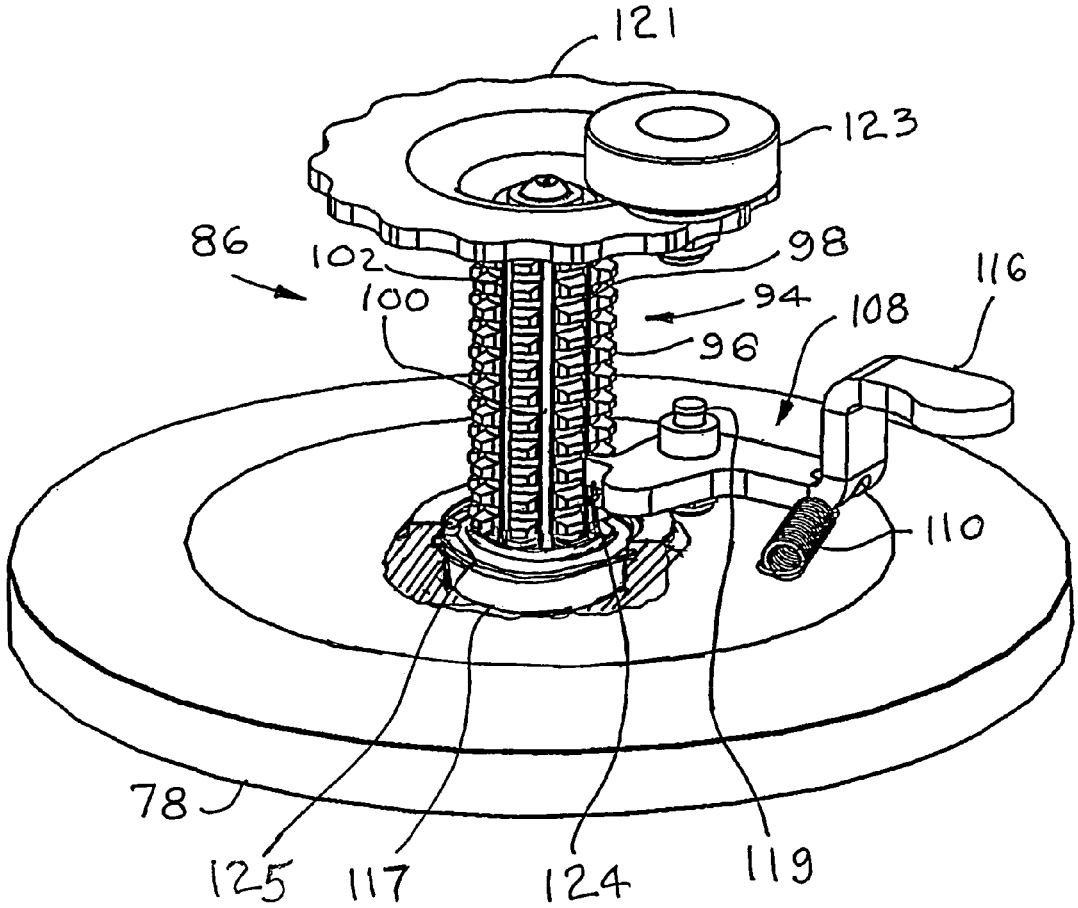
FIG. 7 is a view similar to that of FIG. 6, except with the collar omitted, to more clearly show engagement of the pawl with the lead screw.
Figure 8:
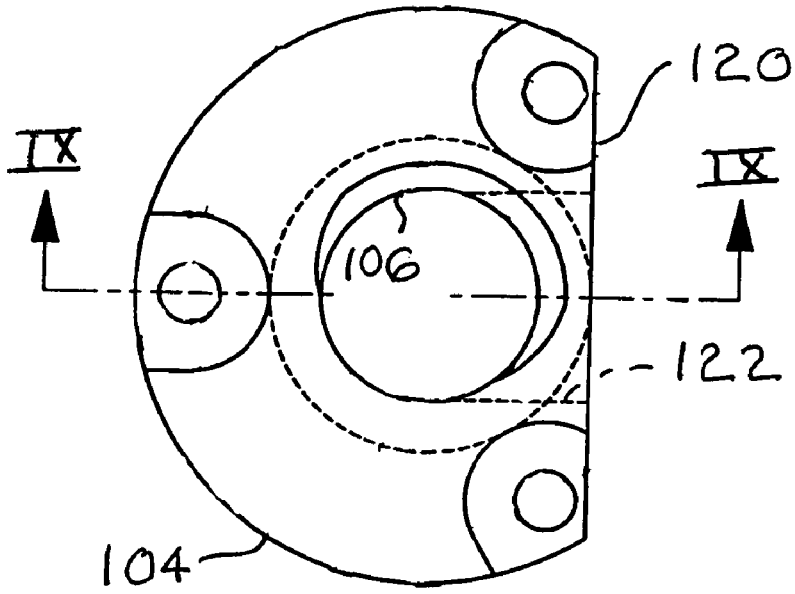
FIG. 8 is a top plan view of the collar.
Figure 9:
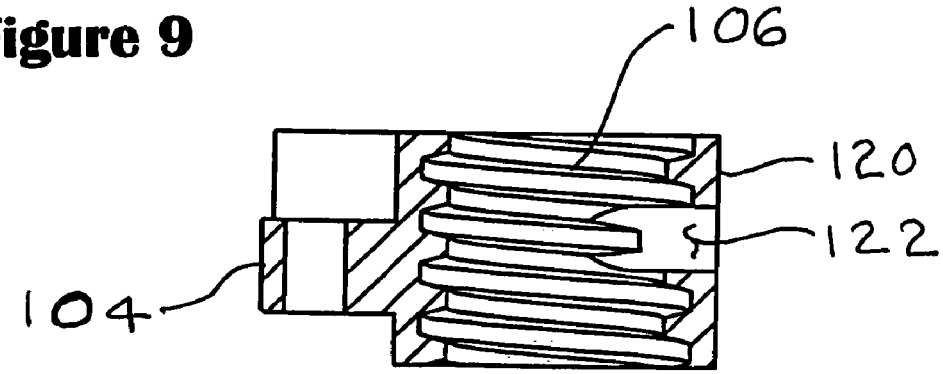
FIG. 9 is a side section view of the collar taken along line IX-IX of FIG. 8.
Figure 10:
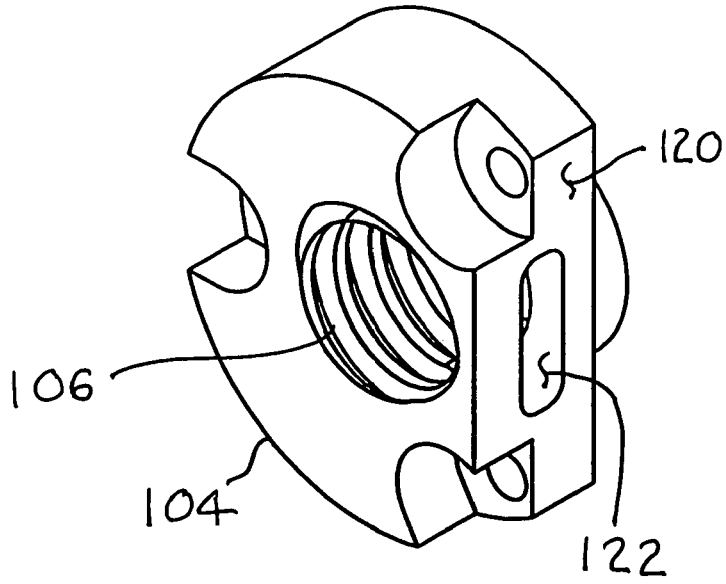
FIG. 10 is a perspective view of the collar.
Figure 11:
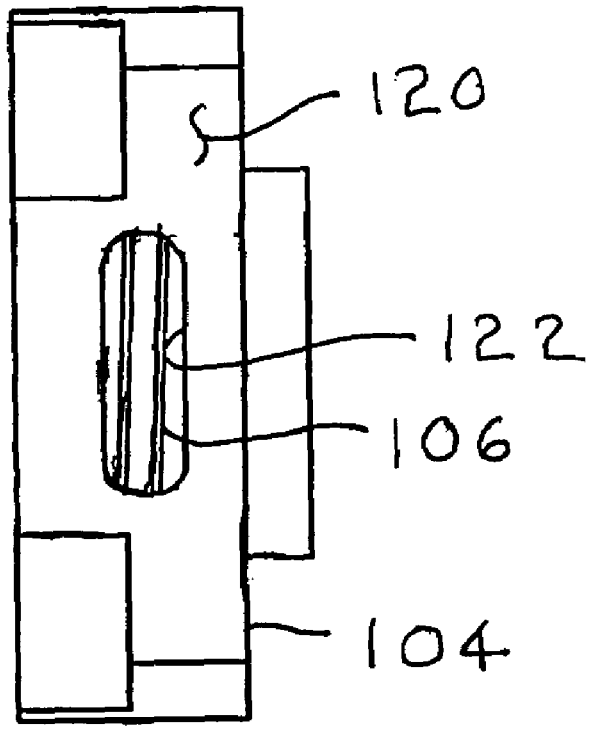
FIG. 11 is a side view of the collar.
Figure 12:
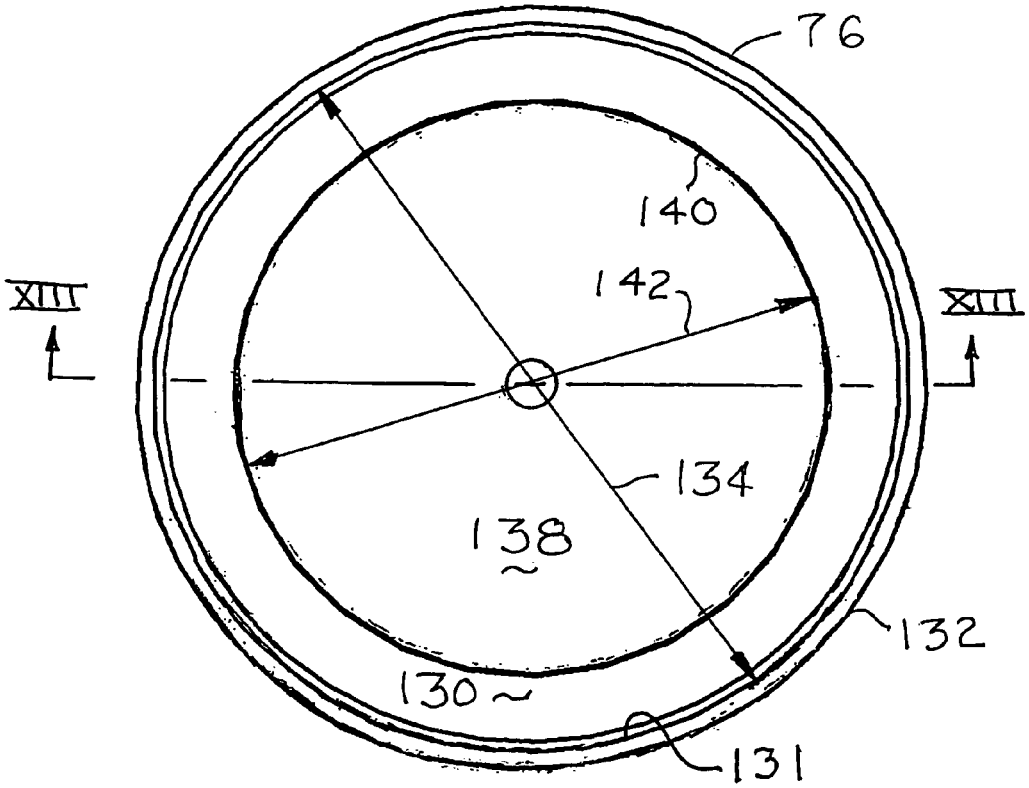
FIG. 12 is a top plan view of a support plate useful in the practice of the present invention.
Figure 13:
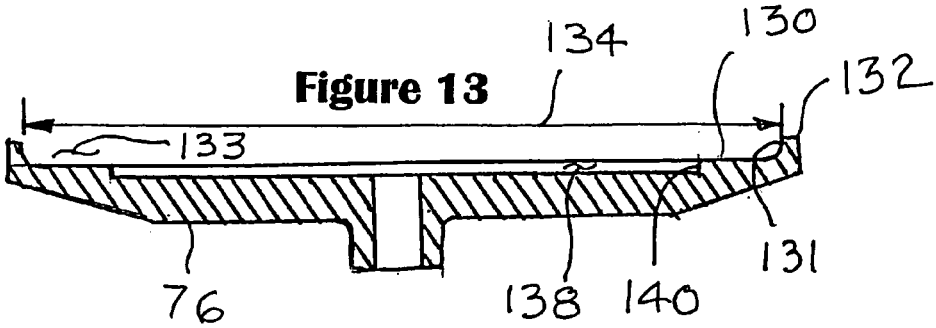
FIG. 13 is a side section view taken along line XIII-XIII in FIG. 12 of the support plate.
Figure 14:
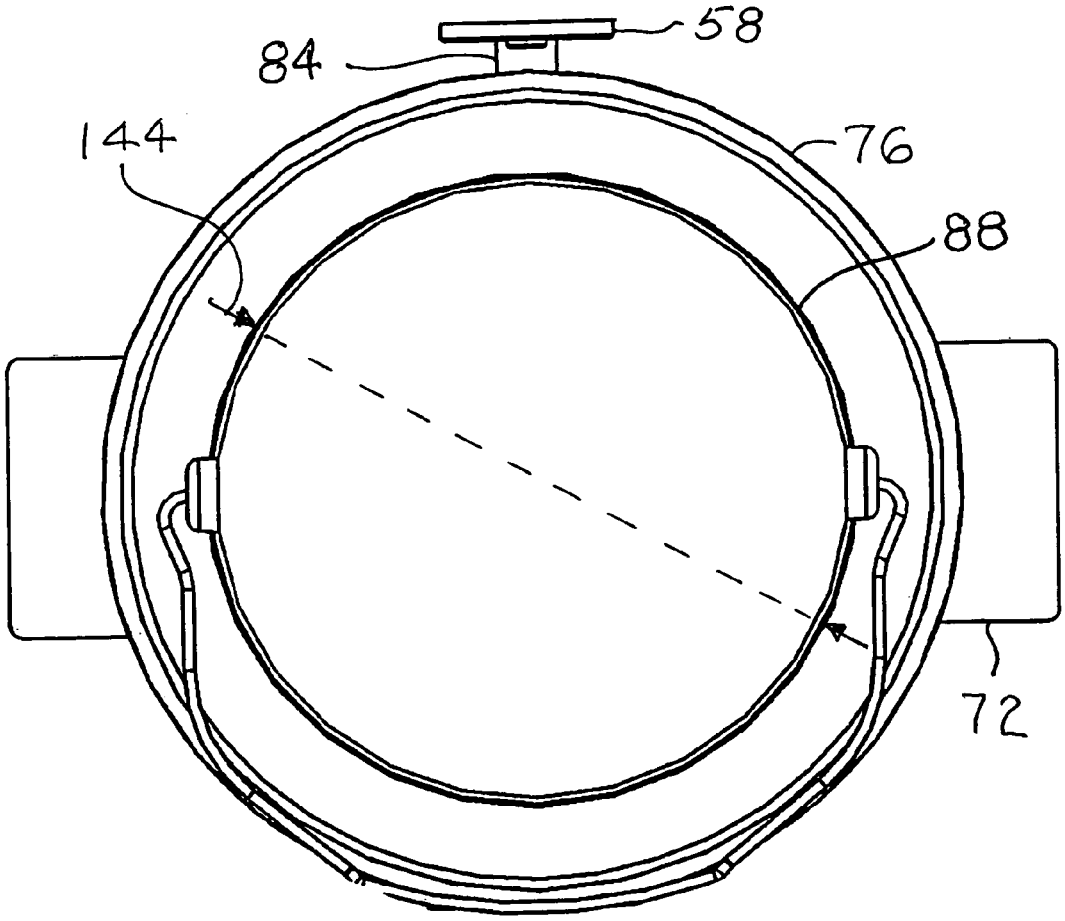
FIG. 14 is a view similar to FIG. 12, except showing a cylindrical paint container resting on the support plate.
Figure 15:
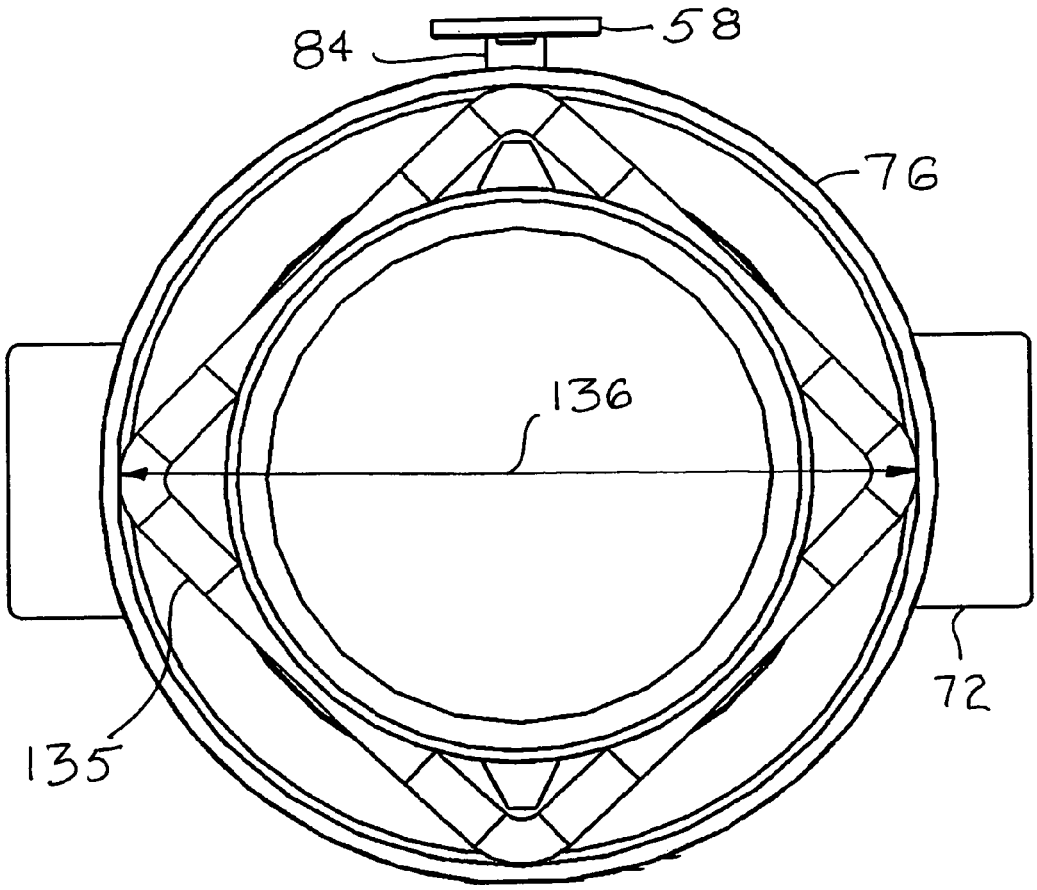
FIG. 15 is a view similar to FIG. 12, except showing a square paint container resting on the support plate.
Figure 16:
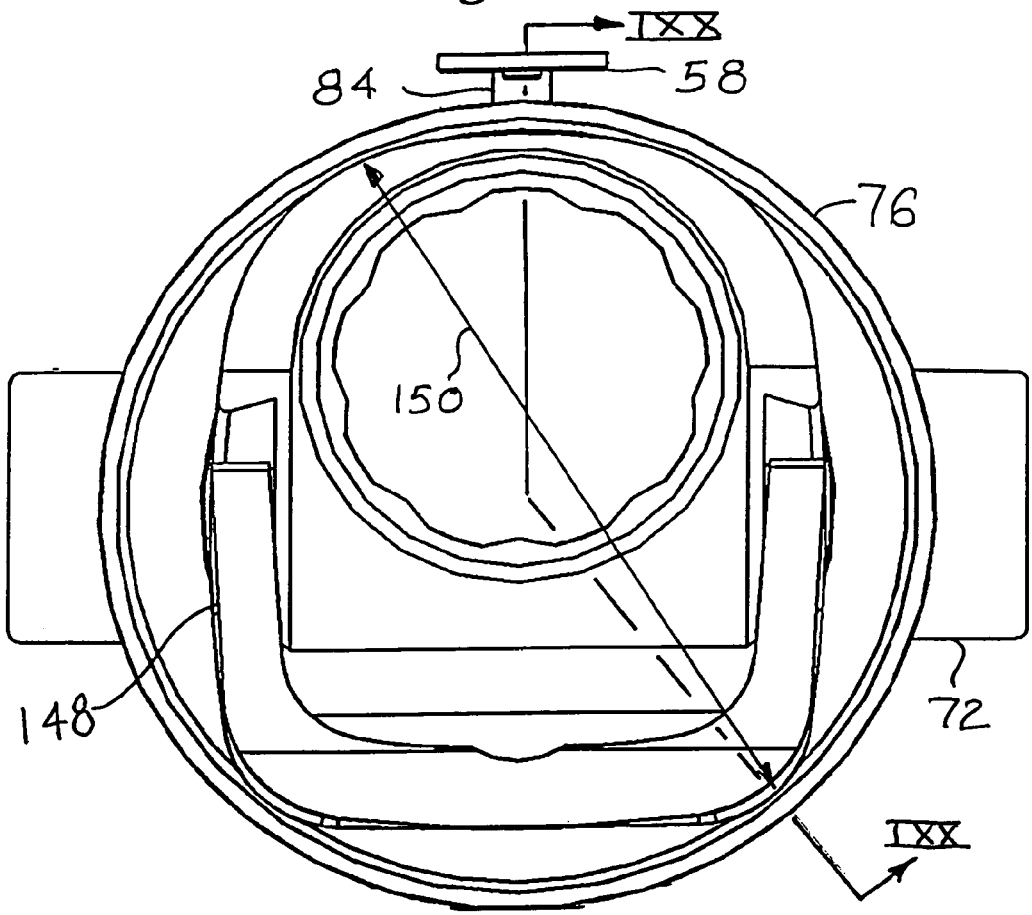
FIG. 16 is a view similar to FIG. 12, except showing a D-shaped paint container resting on the support plate.
Figure 17:
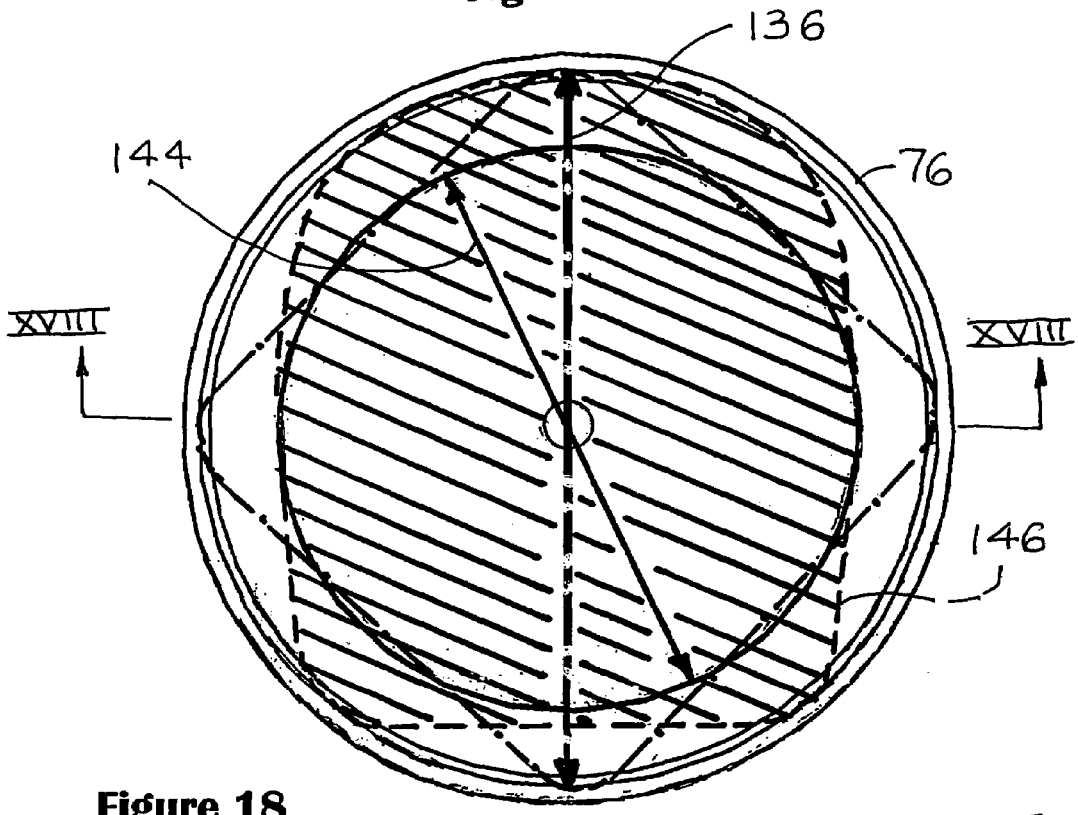
FIG. 17 is a top plan view of the support plate showing the footprints of the cylindrical, square and D-shaped containers.
Figure 18:
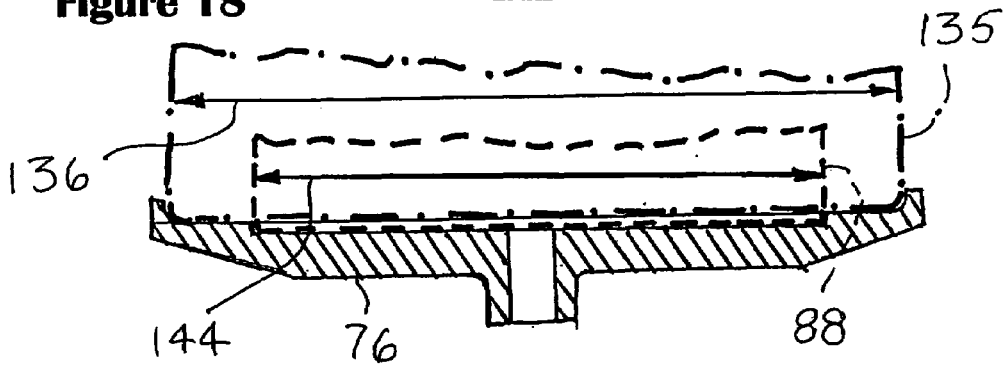
FIG. 18 is a section view taken along line XVIII-XVIII in FIG. 17 along with fragmentary phantom outlines of the cylindrical and square paint containers.
Figure 19:
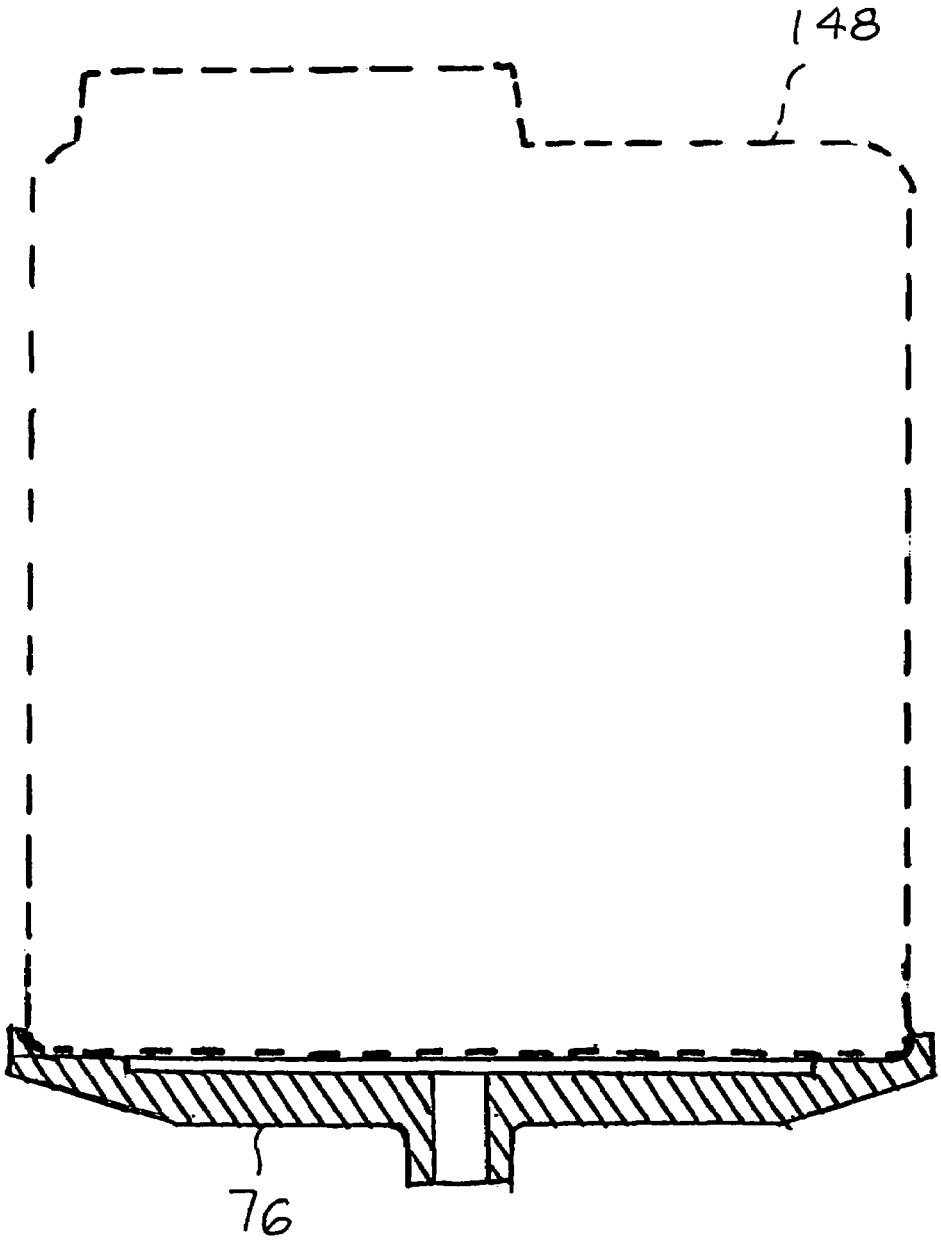
FIG. 19 is a section view taken along line IXX-IXX in FIG. 16 showing the D-shaped paint container in outline.

Referring now also to FIGS. 8-10, the collar 104 has a female mating thread 106 corresponding to thread 96 receiving the lead screw 94. Alternatively, female threads may be formed integrally in the upper member 74 to form the collar. The apparatus 86 also includes a pawl 108 having a tooth 124 engaging one of the axial reliefs of the lead screw. The pawl 108 is arranged to be urged into engagement with the lead screw by a spring 110 to permit rotation of the lead screw in a first direction 112 which advances the lead screw 94 into the collar 104. The pawl 108 selectively prevents rotation of the lead screw 94 in a second direction 114 opposite to the first direction 112. The apparatus 86 may include the pressure plate 78. Apparatus 86 carries pressure plate 78 via a bearing 117 and snap ring 125, to advance and retract the pressure plate with respect to the support plate 76, while permitting rotation of the pressure plate 78 with respect to the lead screw 94 and clamping frame 70. Bearing 117 primarily carries a thrust load and secondarily a radial load. Pawl 108 has a handle 116 for releasing the engagement of the pawl with the lead screw to permit rotation of the lead screw 94 in the second direction 114, retracting the lead screw 94 through the collar 104 and opening up the distance between the pressure plate 78 and the support plate 76, for inserting or extracting a paint container from the clamping frame 70. Pawl 108 is moved in direction 118 (see FIG. 4) to pivot about pin 119 to release engagement of the pawl 108 with the lead screw 94. FIG. 7 shows the clamp and lock apparatus 86 without the collar to more clearly illustrate the engagement of the pawl with the lead screw. It is to be understood that in the embodiment shown the pawl 108 is pivotably mounted to the clamping frame 70 for selective engagement with and release from one of the axial reliefs in the lead screw. A handle 121 and a knob 123 are attached to the lead screw 94 to enable a convenient manual grasp to rotate the lead screw 94 with respect to the clamping frame 70.

Figure 5:
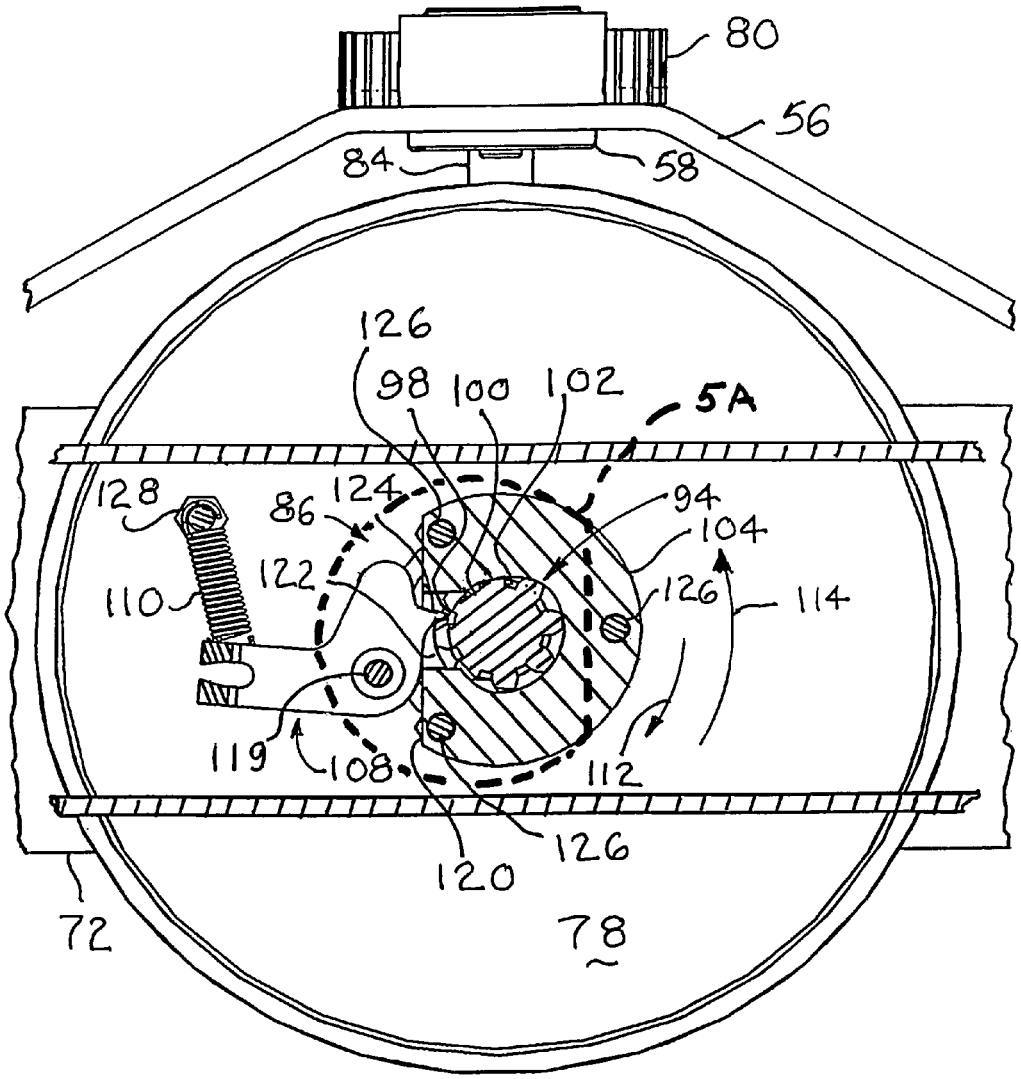
FIG. 5 is a fragmentary top section view taken along line V-V in FIG. 2 of a clamp and lock apparatus useful in the practice of the present invention.
Figure 5A:
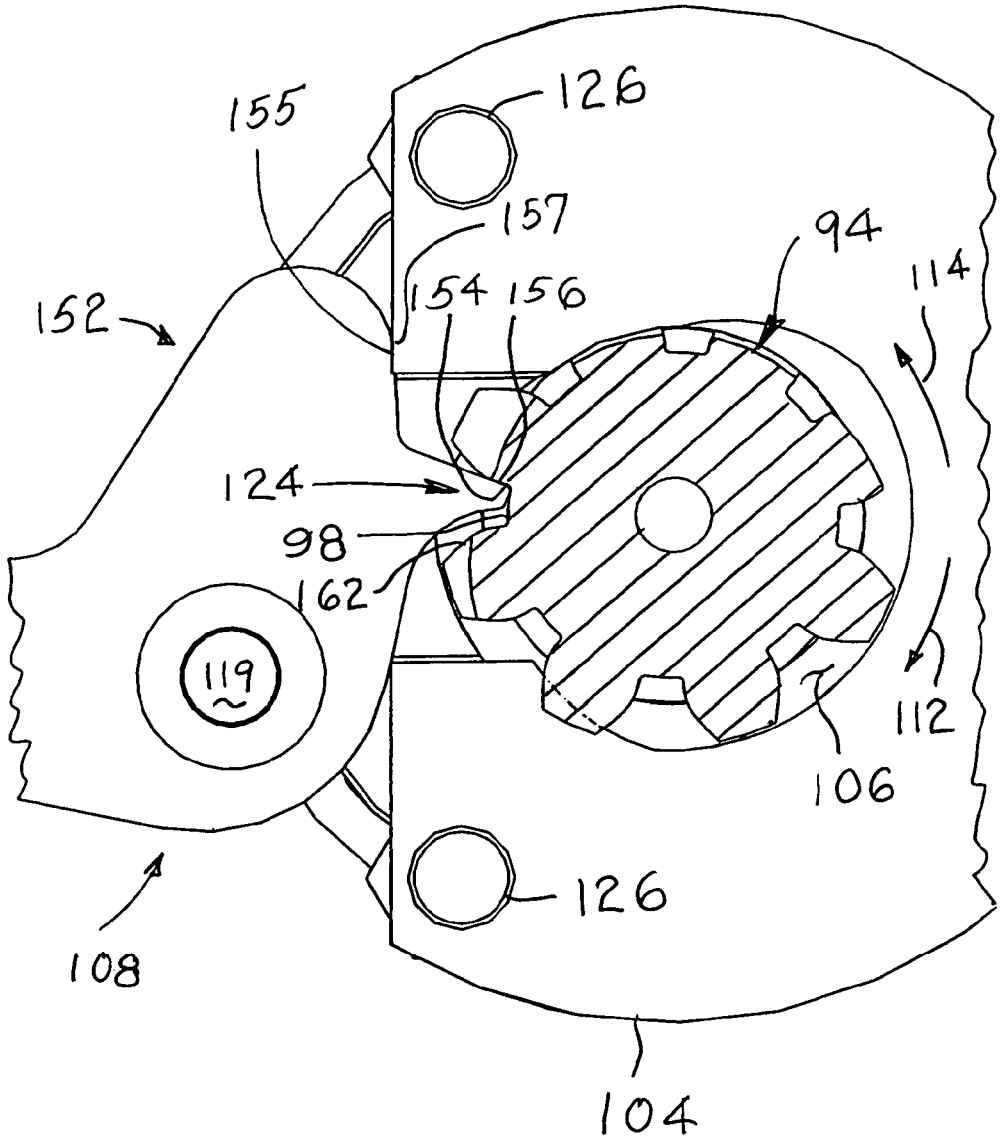
FIG. 5A is an enlarged view of the detail 5A of FIG. 5, with parts shown in a locked condition.
Figure 5B:
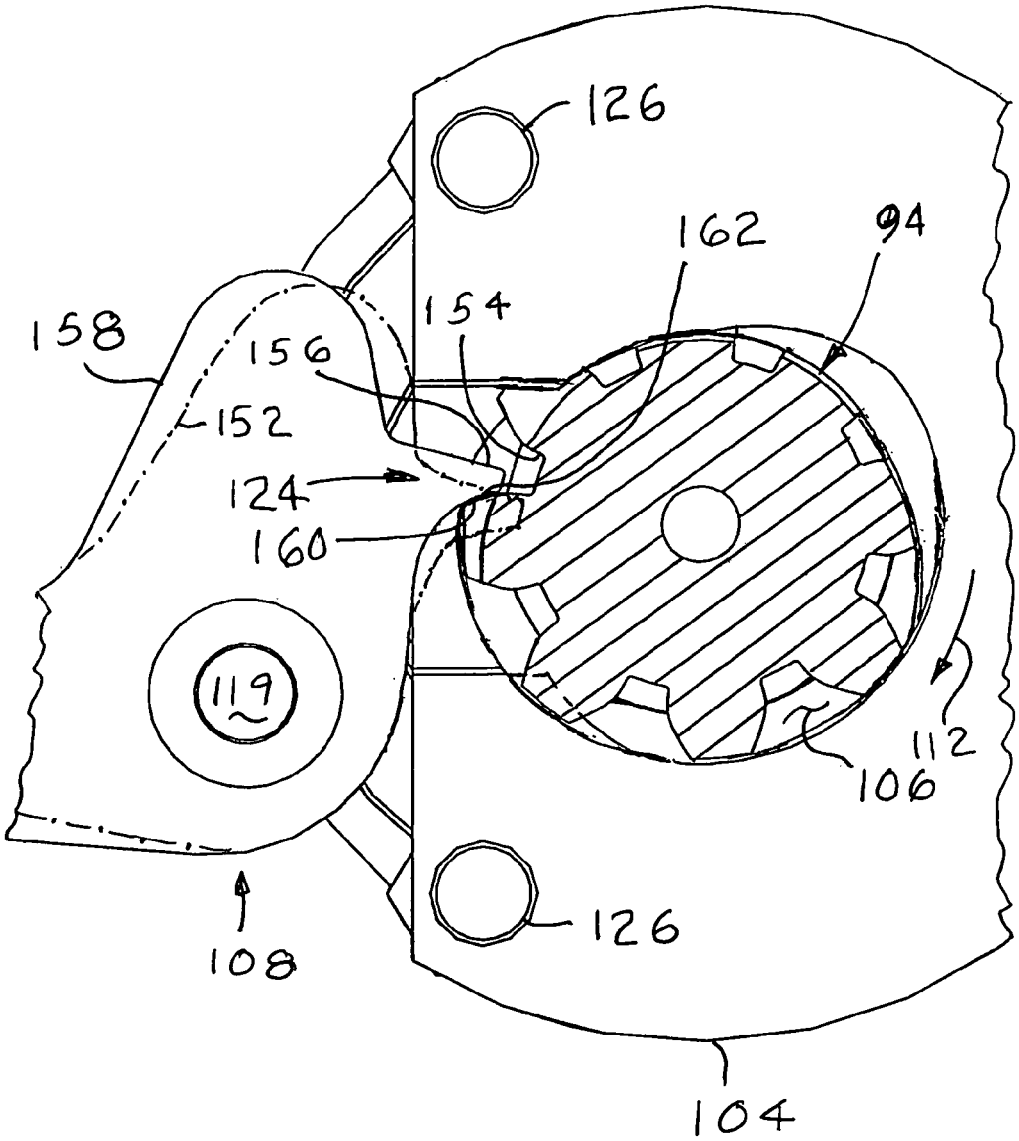
FIG. 5B is a view similar to that of FIG. 5A, except with parts advanced to a state of partial release.
Figure 5C:
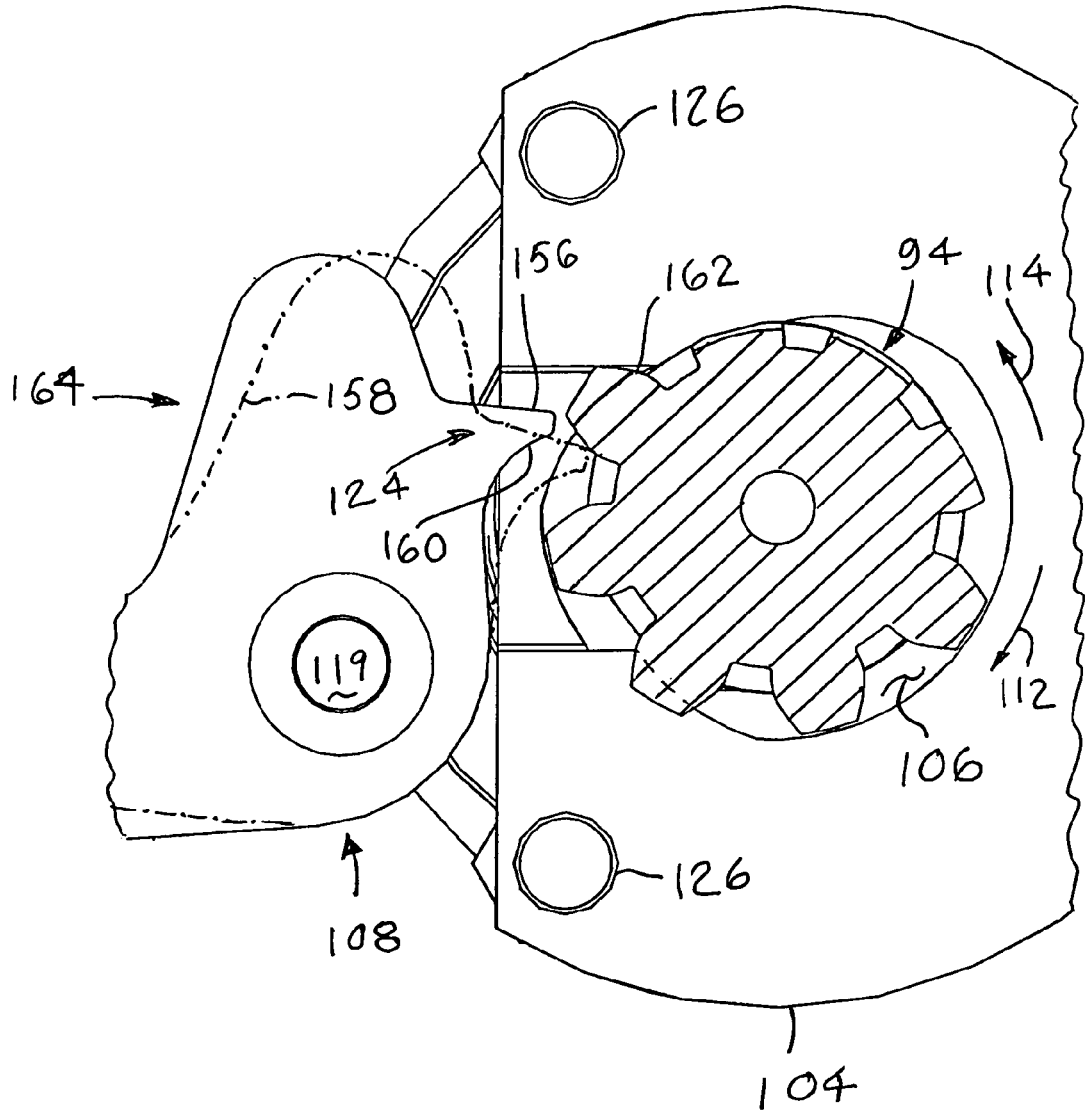
FIG. 5C is a view similar to that of FIG. 5B, except with parts still further advanced to a state of full release or unlocked condition.
Figure 6:
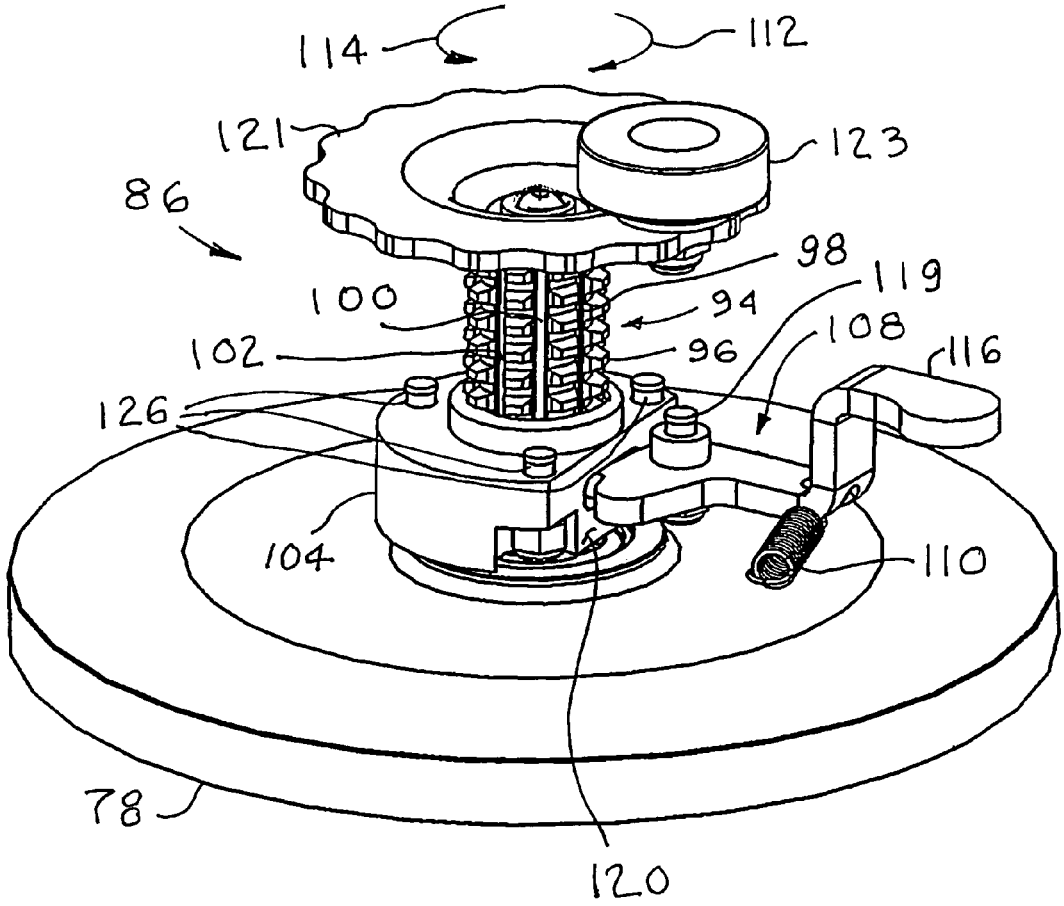
FIG. 6 is a perspective view of the clamp and lock apparatus having a lead screw, pawl, and collar useful in the practice of the present invention.

Referring now most particularly to FIGS. 5 through 5C, an enlarged section view of certain parts of the clamp and lock assembly 86 may be seen. FIG. 5A shows the pawl 108 in a first, or LOCKED position 152 in which a first face or wall 154 in lead screw 94 abuts a first side 156 of the tooth 124 of pawl 108, preventing rotation of the lead screw in the direction indicated by arrow 114. In addition, a surface portion 155 of collar 104 may contact a stop portion or surface 157 on pawl 108 to prevent further rotation of the pawl 108 in a clockwise direction from the position shown in FIG. 5A. It is to be understood that pawl 108 will prevent rotation of lead screw 94 in the direction 114 with the pawl engaged as shown in FIG. 5A, both because of the "stop" feature of the contact between surfaces 155 and 157, and also because of the interference (or lack of clearance) between tooth 124 and axial relief 98 for lead screw 94 to rotate in the direction 114 with the pawl 108 engaged as shown in FIG. 5A. FIG. 5B shows pawl 108 in an intermediate position 158 in solid lines, with the LOCKED or first position 152 shown as a chain line. In FIG. 5B, a second side 160 of tooth 124 is in contact with a second face or wall 162 on lead screw 94, since lead screw 94 has been rotated in the direction indicated by arrow 112. In FIG. 5C, the clamp and lock assembly 86 is shown in an UNLOCKED position 164, with the pawl 108 fully disengaged from the lead screw 94. In FIG. 5C, the intermediate position 158 is shown as a chain line.

Referring now most particularly to FIGS. 7-11, collar 104 may also have a flat 120 with an opening 122 through which the tooth 124 of the pawl projects to engage one of the axial recesses of the lead screw. The collar 104 may be preferably attached to upper member 74 of the clamping frame 70 by three bolts 126 (shown in FIGS. 5 and 6). Alternatively, the collar may be formed integrally in member 74. It is also to be understood that pin 119 is also attached to the upper member 74, as is a spring mounting bolt 128, shown in FIG. 5.

Figure 7A:
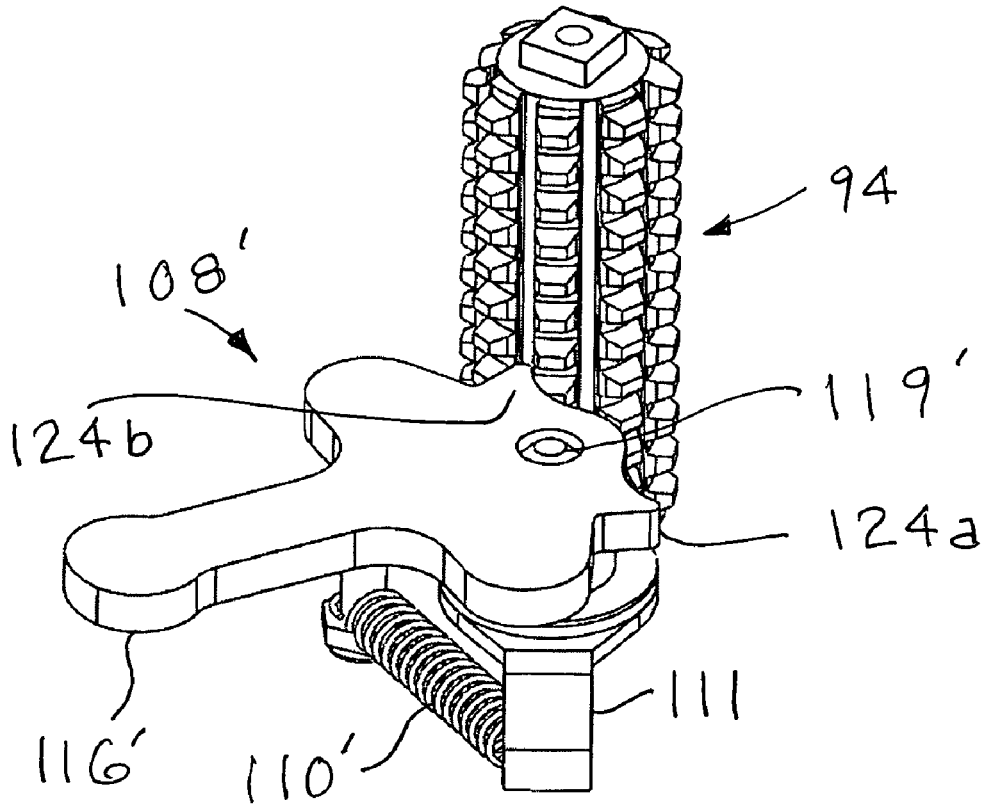
FIG. 7A shows an alternative embodiment for a pawl assembly, along with the lead screw, in a perspective view.
Figure 7B:
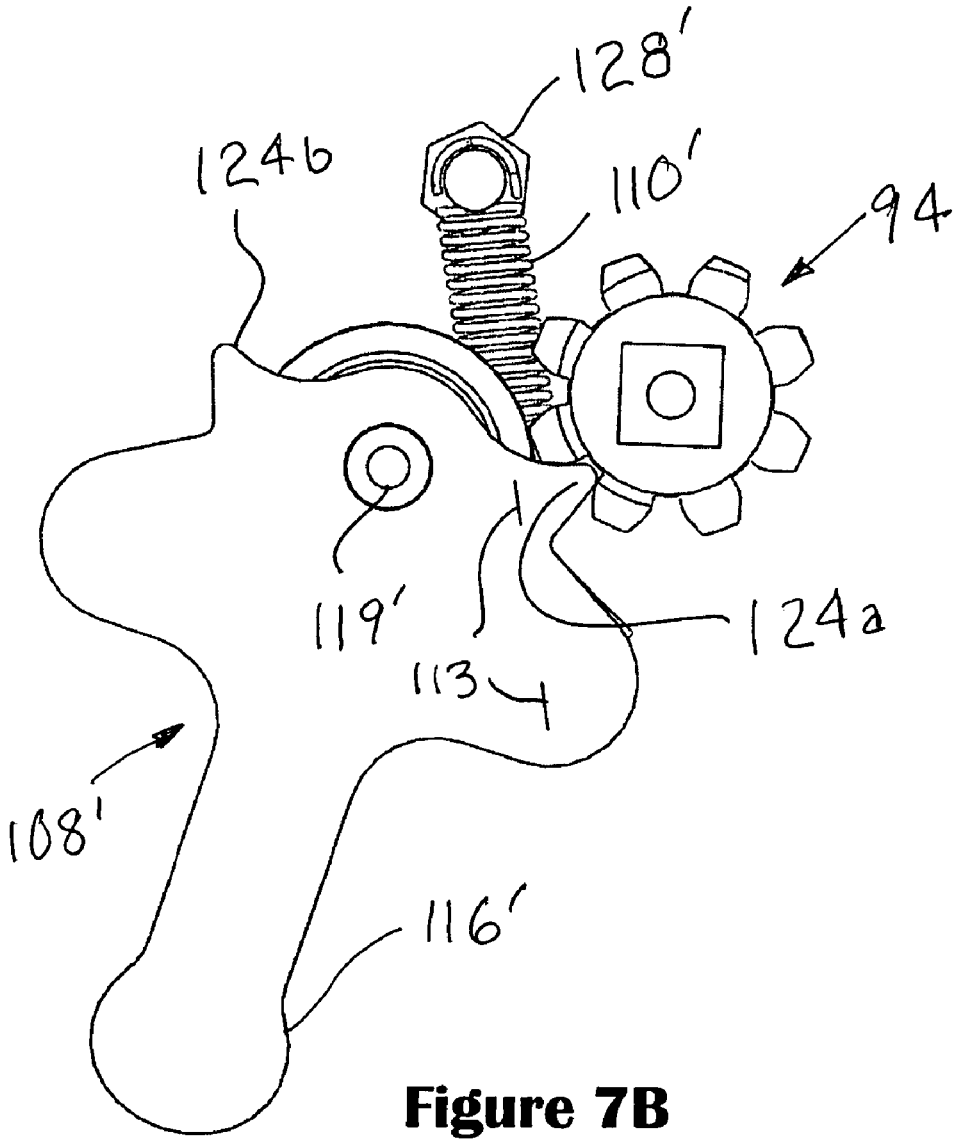
FIG. 7B shows a top plan view of the alternative pawl of FIG. 7A, along with the lead screw, in a first position.
Figure 7C:
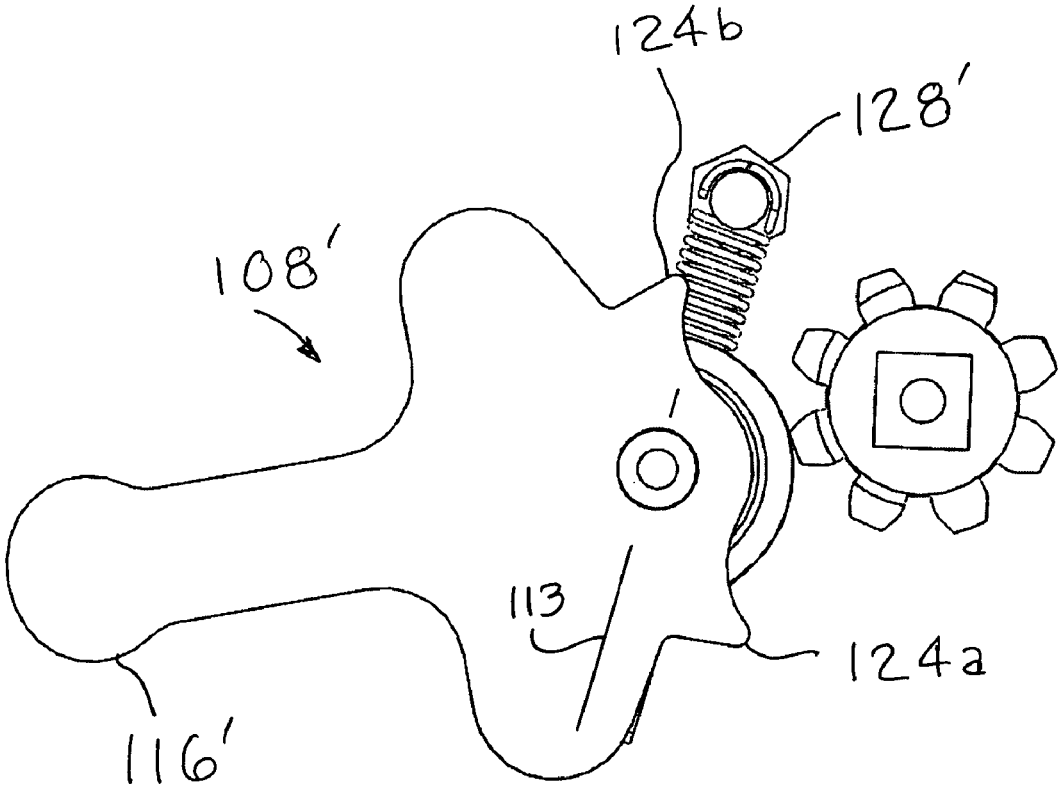
FIG. 7C shows a top plan view of the alternative pawl of FIG. 7A, along with the lead screw, in a second position.
Figure 7D:
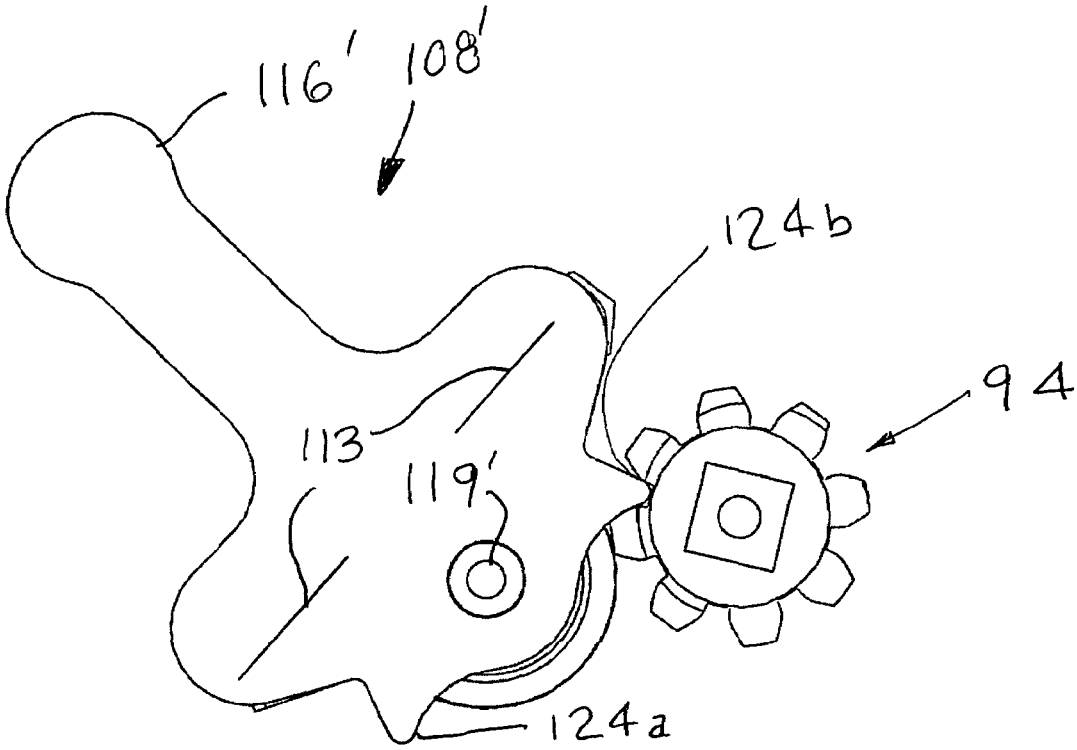
FIG. 7D shows a top plan view of the alternative pawl of FIG. 7A, along with the lead screw, in a third position.

Referring now most particularly to FIGS. 7A-7D, an alternative pawl assembly 108' may be seen along with lead screw 94, with parts omitted to more clearly illustrate certain aspects of the present invention. In this embodiment, pawl 108' has an over-center design where spring 110' acts along an axis 113 which moves from one side of pin 119' to the other side of pin 119.' Furthermore, the pawl 108' may be positioned in an intermediate position in which the axis 113 passes through pin 119.' FIG. 7A shows the pawl 108' in a second position, corresponding to the position shown in FIG. 7D, in which the lead screw is free to rotate clockwise, as viewed in FIG. 7D. With the pawl 108' in this position, the lead screw is prevented from rotating counterclockwise. Spring 110' is extended between a fixed spring mounting bolt 128' and a spring attachment finger 111 located on and movable with pawl 108.' As may be seen in these Figures, pawl 108' has two teeth, 124*a* and 124*b*, respectively engagable with each of the axial recesses or reliefs 98 in lead screw 94. Pawl 108' also preferably has a handle 116' to operate pawl 108' between the respective positions. With the pawl 108' located as shown in FIG. 7B, lead screw 94 is free to be rotated in a counterclockwise direction, as viewed in FIG. 7B, and is prevented from rotation in a clockwise direction. With the pawl 108' located in the position shown in FIG. 7C, lead screw 94 is free to be rotated in either direction.

Figure 7E:
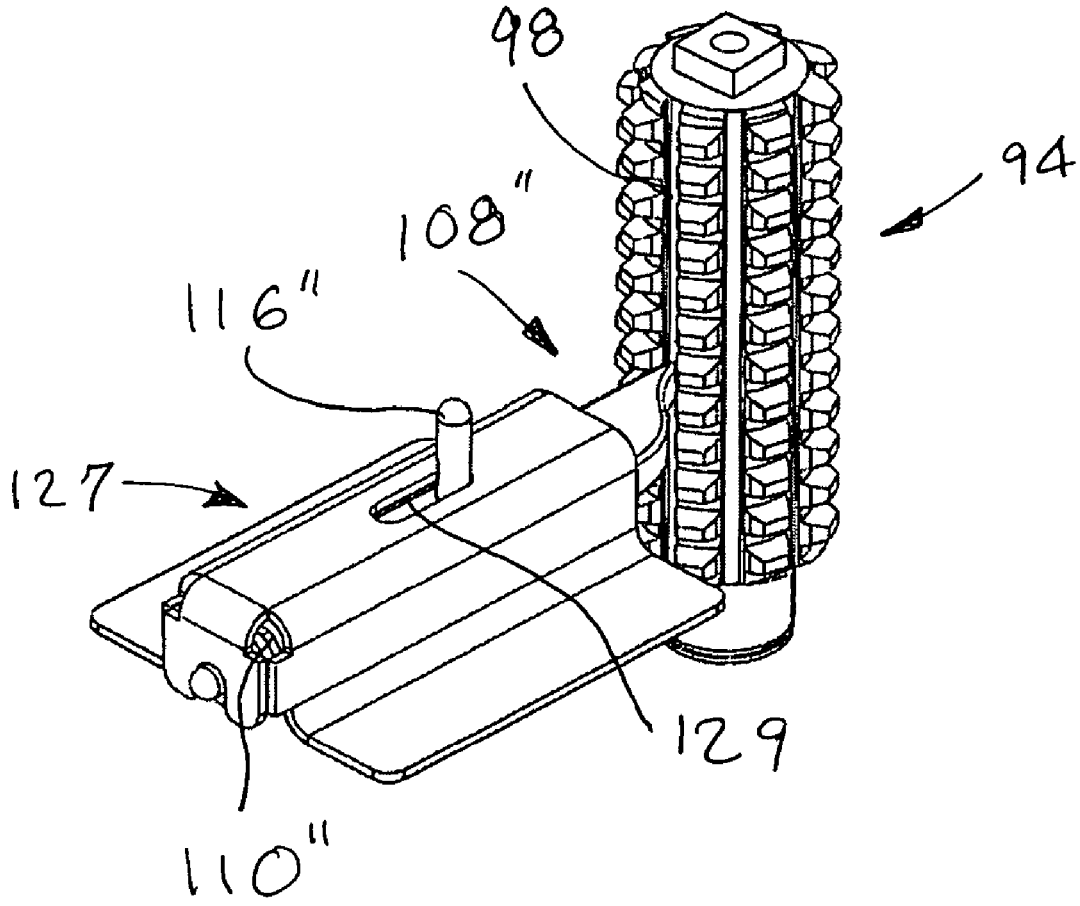
FIG. 7E shows another alternative embodiment for a pawl assembly, along with the lead screw, in a perspective view.
Figure 7F:
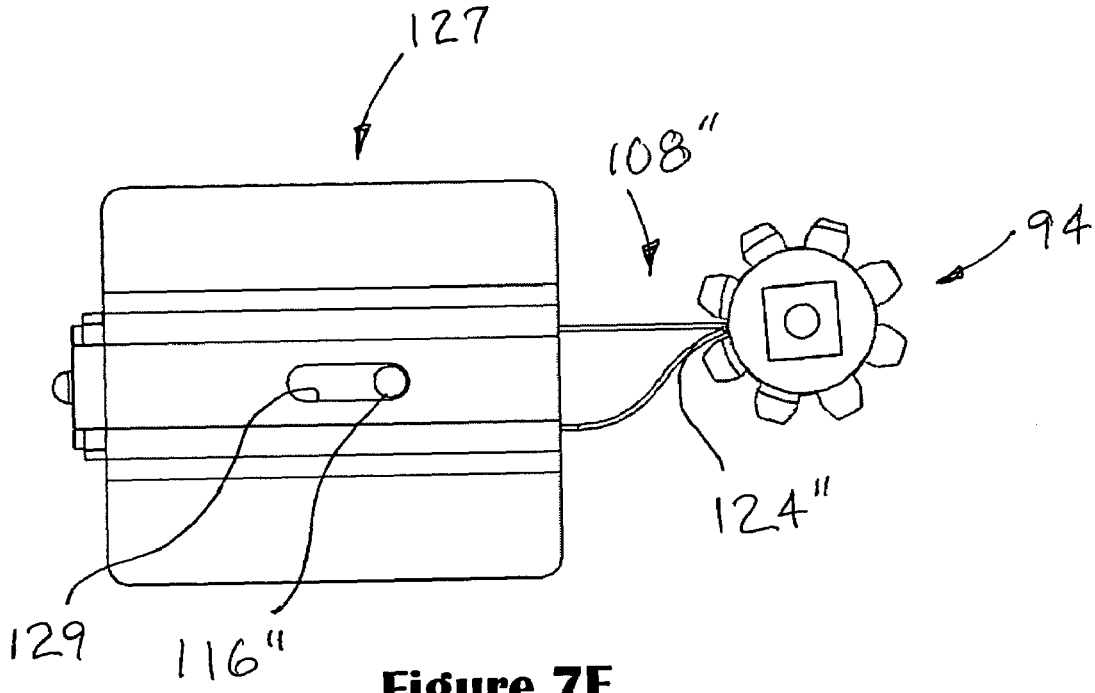
FIG. 7F shows a top plan view of the pawl of FIG. 7E, along with the lead screw, in a first position.
Figure 7G:
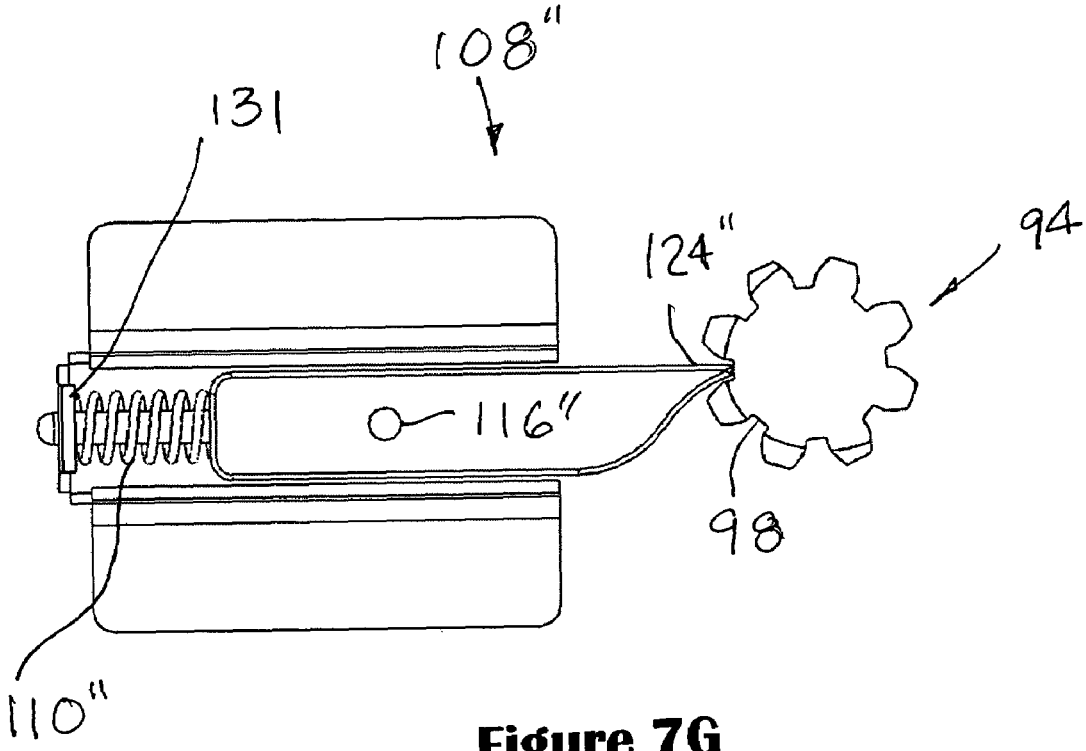
FIG. 7G shows a top plan view similar to that of FIG. 7F, except with a cover removed to show internal details of the pawl assembly.
Figure 7H:
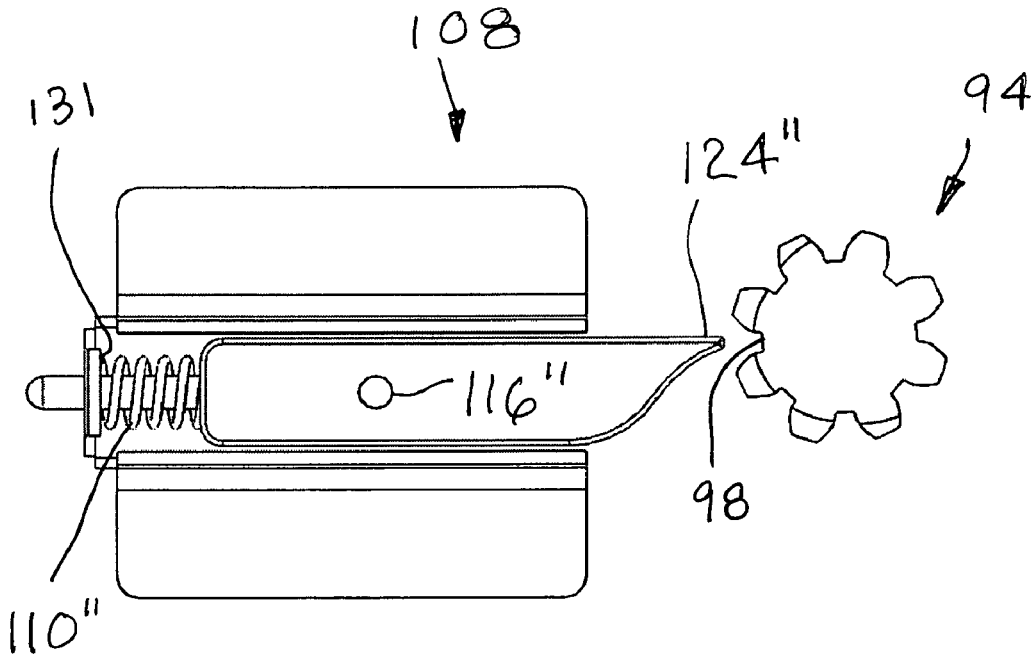
FIG. 7H shows a top plan view similar to that of FIG. 7G, except with the pawl in a second position.

Referring now to FIGS. 7E-7H, a still further alternative embodiment pawl assembly 108" may be seen, along with lead screw 94, with parts omitted to illustrate certain aspects of the present invention. In this embodiment, the pawl 108" operates with a linear motion. A handle 116" may be used to manually retract a tooth 124" of pawl 108" from engagement with lead screw 94, as shown in FIG. 7H. When handle 116" is released, pawl 108" is urged by spring 110" towards lead screw 94, such that the tooth 124" engages one of the axial recesses or reliefs 98 in the lead screw 94, as shown in FIGS. 7E, 7F, and 7G. FIGS. 7E and 7F show a cover 127 having a slot 129 for handle 116" to project through. FIGS. 7G and 7H show the cover 127 removed, to illustrate that the spring 110" reacts between an end wall 131 and the sliding pawl 108."

From the above, it may be seen that in one aspect, the present invention includes a method of selectively clamping and locking a paint container in a paint mixer by advancing a lead screw (preferably by manually grasping and rotating a handle attached to the lead screw), with the lead screw carrying a pressure plate to urge the pressure plate against a paint container, and urging a pawl into engagement with an axial relief in the lead screw (via a spring), with the pawl permitting rotation of the lead screw in a first direction to advance the lead screw and selectively preventing rotation of the lead screw in a second direction opposite to the first direction to prevent retraction of the lead screw and release of the paint container by the pressure plate. The method may also include manually disengaging the pawl from the lead screw, and retracting the lead screw to release the pressure plate from the paint container.

In a first alternative embodiment, the pawl may have an over-center design to hold it in one of at least two, and possibly three positions, with a first position (LOCKED) engaged with the lead screw preventing retraction of the lead screw from clamping a paint container and a second, intermediate position (UNLOCKED) disengaged from the lead screw, permitting rotation of the lead screw in either direction, and in a third (REVERSE LOCKED) position, preventing advancement of the lead screw into engagement and clamping of the paint container. With such an over-center design, the pawl may be alternately arranged to lock the lead screw against rotation in both directions when the pawl is in the LOCKED position, and to permit rotation in both directions when the pawl is in the UNLOCKED position.

As a still further alternative the pawl may be constrained to slide linearly (generally radially) with respect to the lead screw, rather than rotate. With such an arrangement, in one version the pawl may be selective to permit rotation in one direction and prevent rotation in the other direction, or (in another version) may prevent rotation of the lead screw in either direction when the sliding pawl is engaged with the lead screw. With this alternative, a spring is provided to urge the pawl into engagement (in either version).

Referring now also to FIGS. 12-15, 17 and 18, various aspects of the present invention relating to the support plate 76 may be seen. The support plate 76 has a generally flat working surface 130 surrounded by a raised edge 131 (which is preferably, but not necessarily formed by a peripheral lip 132), with the edge or lip forming a first recess 133 on the support plate sized to closely interfit with a generally square paint container 135. An inside diameter 134 of the recess 133 existing within lip 132 is preferably substantially equal to an external diagonal dimension 136 of the square paint container 135.

The support plate 76 also has a second recess 138 formed by a step 140 in working surface 130. The second recess 138 is concentric to the first recess 133 and has an inside diameter 142 substantially equal to an outside diameter 144 of the generally cylindrical paint container 88. By "substantially equal" as to the diameters 134 and 142 in reference to the dimensions 136 and 144 is meant that sufficient clearance is provided to insert and remove the respective containers 135 and 88, while also substantially geometrically centering the respective container when it is received on the support plate 76.

Referring now most particularly to FIGS. 13 and 16-19, it is to be understood that the support plate 76 of the present invention is also sized to closely interfit with a footprint 146 of a generally D-shaped paint container 148 to hold the D-shaped container in a fixed alignment in the clamping frame on the support plate 76. This is accomplished by sizing the diameter 134 of the first recess 133 to closely interfit with a maximal dimension 150 of the container 148.

By "maximal dimension" is meant, for a non-cylindrically shaped container (which may have a non-symmetrical horizontal cross section footprint) the diameter of the smallest cylinder into which the non-cylindrically shaped container footprint will fit. For a rectangular footprint container, the maximal dimension is a diagonal between opposite comers of the rectangular container. For a D-shaped container, the maximal dimension will be a side of an isosceles triangle extending from the mid point of the D-shaped arc to one of the opposite comers, unless the radius of curvature of the D-shaped arc is greater than half the diameter of the maximal dimension cylinder.

In this aspect, the present invention includes a method of geometrically centering one of a plurality of different cross-section paint containers in a gyroscopic paint mixer of the type having a support plate. The method is performed by providing a peripheral lip on the support plate to form a first recess having a first diameter sized to closely interfit with of each of a plurality of non-cylindrical paint containers, where each of the containers has substantially the same maximal dimension, and providing a step in the support plate to form a second recess having a second diameter less than the first diameter and sized to closely interfit with a diameter of a cylindrical paint container. The method also includes placing a paint container on the support plate, where the paint container is selected from the group of: i. non-cylindrical paint containers having a maximal dimension substantially equal to the first diameter, and ii. cylindrical paint containers having a diameter substantially equal to the second diameter such that the paint container is placed within the respective recess within which it closely interfits.

This invention is not to be taken as limited to all of the details thereof as modifications and variations thereof may be made without departing from the spirit or scope of the invention.

The invention claimed is:

1. A method of selectively clamping and locking a paint container in a paint mixer comprising the steps of:

a. advancing a lead screw having a helical thread and carrying a pressure plate to urge the pressure plate against a paint container; and b. urging a pawl into direct engagement with an axial relief formed in the helical thread in the lead screw, wherein the pawl permits rotation to advance the lead screw and selectively prevents rotation in the opposite direction to prevent retraction of the lead screw and release of the paint container by the pressure plate.

2. The method of claim 1 further comprising the additional steps of:

c. manually disengaging the pawl from the lead screw; and d. retracting the lead screw to release the pressure plate from the paint container.

3. The method of claim 1 wherein step a. is performed by manually grasping a handle attached to the lead screw and rotating the handle to advance the lead screw.

4. A method of selectively clamping and locking a paint container in a paint mixer comprising the steps of:

a. disengaging a pawl from direct engagement with an axial relief in a helical thread in a lead screw in a paint mixer;

b. advancing the lead screw carrying a pressure plate in a first to urge the pressure plate against a paint container; and b. urging the pawl into direct engagement with the axial relief in the helical thread of the lead screw to prevent rotation of the lead screw at least in a second direction opposite to the first direction.

5. The method of claim 4 wherein the pawl permits rotation in the first direction to advance the lead screw when the pawl is engaged with the lead screw and selectively prevents rotation in the opposite direction.

* * * * *

UNITED STATES PATENT AND TRADEMARK OFFICE

CERTIFICATE OF CORRECTION

PATENT NO. : 7,390,120 B2
APPLICATION NO. : 11/856463
DATED : June 24, 2008
INVENTOR(S) : Thomas J. Midas et al.

It is certified that error appears in the above-identified patent and that said Letters Patent is hereby corrected as shown below:

Column 8, Line 38 [claim 4], insert --direction-- after the word “first”

Column 8, Line 40 [claim 4], delete “b.” and insert therefor --c.--

Signed and Sealed this

Twelfth Day of May, 2009

JOHN DOLL
*Acting Director of the United States Patent and Trademark Office*